United States Patent [19]

Bergeron et al.

[11] Patent Number: 4,588,021

[45] Date of Patent: May 13, 1986

[54] MATRIX COATINGS ON ENDLESS FLEXIBLE METALLIC BELTS FOR CONTINUOUS CASTING MACHINES METHOD OF FORMING SUCH COATINGS AND THE COATED BELTS

[75] Inventors: Norman J. Bergeron, Burlington; Wojtek S. Szczypiorski, Colchester; James G. Villa, Hinesburg, all of Vt.; S. Richard Hazelett, Provo, Utah

[73] Assignee: Hazelett Strip-Casting Corporation, Colchester, Vt.

[21] Appl. No.: 549,752

[22] Filed: Nov. 7, 1983

[51] Int. Cl.[4] ..... B22D 11/06; B05D 1/02

[52] U.S. Cl. ..... 164/432; 164/429; 164/481; 164/72; 427/34; 427/422; 427/423

[58] Field of Search ..... 164/72, 268, 429, 430, 164/431, 432, 479, 481; 427/34, 423, 422

[56] References Cited

U.S. PATENT DOCUMENTS

| | | | |
|---|---|---|---|
| 2,640,235 | 6/1953 | Hazelett | 22/57.4 |
| 2,904,860 | 9/1959 | Hazelett | 22/57.4 |
| 3,036,348 | 5/1962 | Hazelett et al. | 22/57.4 |
| 3,041,686 | 7/1962 | Hazelett et al. | 22/57.4 |
| 3,123,874 | 3/1964 | Hazelett et al. | 22/57.4 |
| 3,142,873 | 8/1964 | Hazelett et al. | 22/57.4 |
| 3,167,830 | 2/1965 | Hazelett et al. | 22/57.4 |
| 3,288,072 | 7/1966 | Hazelett et al. | 22/57.4 |
| 3,844,729 | 10/1974 | Sedlatschek et al. | 427/34 |
| 3,871,905 | 3/1975 | Petry | 427/292 |
| 3,937,270 | 2/1976 | Gazelett et al. | 164/50 |
| 3,955,615 | 5/1976 | Dompas et al. | 164/278 |
| 4,002,197 | 1/1977 | Hazelett et al. | 164/250 |
| 4,027,716 | 6/1977 | Theobald et al. | 164/481 |
| 4,028,101 | 4/1978 | Hazelett et al. | 134/127 |
| 4,039,297 | 8/1977 | Takenaka | 428/566 |
| 4,155,396 | 5/1979 | Dompas et al. | 164/431 |
| 4,239,081 | 12/1980 | Kranz | 164/431 |
| 4,260,008 | 4/1981 | Kranz | 164/431 |
| 4,298,053 | 11/1981 | Dompas et al. | 164/429 |

FOREIGN PATENT DOCUMENTS

| | | | |
|---|---|---|---|
| 1062877 | 9/1979 | Canada | 22/157 |
| 49-46526 | 12/1974 | Japan | 427/423 |

*Primary Examiner*—Nicholas P. Godici
*Assistant Examiner*—Richard K. Seidel
*Attorney, Agent, or Firm*—Parmelee, Bollinger & Bramblett

[57] ABSTRACT

A unitary-layer partially metallic, suitably adherent, mechanically and thermally durable, non-wetting, fusion-bonded matrix coating on endless, flexible metallic casting belts for continuous casting machines is described. This fusion-bonded matrix coating is also advantageous for coating other molten-metal-contacting surfaces, in continuous casting machines, such as edge-dam blocks that define moving side walls of a mold cavity. The fusion-bonded matrix (or reticulum) coating provides advantageous accessible porosity throughout the coating and comprises a nonmetallic refractory material interspersed substantially uniformly throughout a matrix of heat-resistant metal or metal alloy, for example nickel or nickel alloy, which is fusion-bonded to the grit-blasted surface of the belt and anchors and holds the nonmetallic material. The coating is applied by thermally spraying a powdered mixture directly on the roughened surface. The result is to insulate and protect the underlying belt from intimate molten metal contact, from heat stress and consequent distortion and from chemical or stress-corrosive action by the molten metal or its oxides or slags. The nonmetallic material may be present, at least partly, in the form of isolated particles encased within the metallic reticulum and/or in the form of a second reticulum intertwined with the metallic reticulum. The life of the coated belts is dramatically increased, and the surface quality and properties of the cast product are significantly improved. The coating controls and renders more uniform the rate of freezing of the metal being cast, resulting in improved metallurgical properties. Formulations are described and a method of forming such coatings by thermal spraying.

111 Claims, 6 Drawing Figures

P
30
22
22
U
A
A
14
22
10
C
20
18
L
16
28
31
12
22

MATRIX COATINGS ON ENDLESS FLEXIBLE METALLIC BELTS FOR CONTINUOUS CASTING MACHINES METHOD OF FORMING SUCH COATINGS AND THE COATED BELTS

TECHNICAL FIELD

This invention relates primarily to the flexible belts used in continuous casting machines for the casting of ferrous and non-ferrous metals. More particularly, this invention is directed to protective and thermally insulating matrix coatings, the methods of forming such coatings, the composition of the coatings, and the coated belts so produced. The casting belts are usually made of mild steel. Secondarily, the invention applies to the coating of other molten-metal-contacting surfaces in continuous casting machines, such as the coating of edge-dam blocks.

BACKGROUND

Numerous combinatins of oils, graphite, soot, diatomaceous earth, silica, organic binders, etc., have been used to protect metallic casting belts or to insulate them and/or to act as parting agents to prevent adherence to the belts in continuous casting machines for casting molten metal. Such prior coatings are temporary or transitory in nature and may be continually applied and replenished during casting. The continual application of such coatings while casting requires precise maintenance and control in view of the need for consistent thermal conductivity. This continual application and replenishing of temporary insulative coatings is a difficult and imprecise art. For example, excess liquid or solvent or binder in the insulating coating material is likely to emanate gas in such quantity as to disturb the soundness of the cast product, resulting in porosity. Some of the gas thus liberated is at times hydrogen, which can detrimentally alter the metallurgical qualities of the cast metal. Also excess amounts of the temporary insulative coating material itself may accumulate near the edges of the cast product and usurp part of the continuously moving mold space, causing defects in the cast product.

A two-layer belt coating, including thermosetting resin and solvent, for use in continuously casting relatively low melting-point metals, such as aluminum, zinc and lead is described in U.S. Pat. No. 3,871,905. Coatings containing resins are generally unsuitable for use for continuously casting metals having melting-point temperatures significantly higher than aluminum.

A casting belt made of mild killed steel containing 0.2% to 0.8% by weight of titanium has been multiple-layer coated, as described in U.S. Pat. No. 4,298,053. The surface of the belt is first coated by a "primer" layer of a nickel-aluminum alloy (80% by wt. of Ni and 20% by wt. of Al) stated to be 0.005 mm thick in the specification but claimed to be 0.05 mm thick in the only claim. This primer layer is coated by another layer between 0.01 and 0.5 mm thick made of chromium, or of an alloy of chromium, or of nickel, or of an alloy of nickel or of a stainless steel. Then, a third layer of colloidal graphite anti-adhesion agent is applied over the second layer. However, in our experience more thermal insulation and additional non-wettability are required than can be obtained by following the teaching of that patent.

Canadian Patent No. 1,062,877 of Thym and Gyongyos describes the coating of endless casting belts by several thin layers (80–100 micrometers, preferably 50–70 micrometers) on the endless casting belts until the desired thickness of ceramic layers is achieved to give the requisite thermal resistance. Such a build-up of multiple ceramic layers is laborious, time-consuming and expensive. The resulting built-up coating is machined mechanically, e.g. by grinding, in order to achieve the desired uniform surface finish and wetting behavior between this multiple-layer ceramic coating and the aluminum being cast. This built-up ceramic coating consists of $Al_2O_3.CaZrO_3$, $Al_2O_3.MgO$, $ZrSiO_4$ or $Al_2O_3.TiO_2$. It is built up in thickness until it provides thermal resistance in the range of $10^{-4}$ to $10^{-3}$ $m^2.h.°C./kcal$.

Such built-up ceramic coatings are usually relatively thick and relatively fragile and brittle. They have insufficient durability to withstand thermal shock, or to withstand the mechanical stretching and relaxing, the flexing and abrading which are inherent in continuous casting employing one or more moving belts as molten-metal-contacting-cooling surfaces.

Durability to withstand such mechanical and thermal stresses are important, as otherwise bits of the ceramic coating become loose and spall during the demanding service imposed upon them in continuous casting of molten metals. The loosened bits inevitably become inclusions in the cast metal product. Such inclusions can become a serious problem, as for instance in the case of copper destined for drawing into fine wire. Such inclusions cause the wire to break in the dies, resulting in significant productivity losses as the wire is restrung. Ceramic coatings are generally not flexible and tend to be fragile.

Problems associated with brittleness, ceramic flake-off and contamination of the cast product by ceramic particles are highlighted in German patent No. 24 11 448 of Theobald, in which patent an attempt was made to solve this problem when casting aluminum by applying over the relatively thick ceramic a second and protective abrasion resistive metal layer which has a higher temperature point of fusion than the metal to be cast.

SUMMARY OF THE DISCLOSURE

A unitary-layer partially metallic, suitably adherent, mechanically and thermally durable, non-wetting, fusion-bonded matrix coating on endless, flexible metallic casting belts for continuous casting machines is described. This fusion-bonded matrix coating is also advantageous for coating other molten metal-contacting surfaces in continuous casting machines, such as edge-dam blocks that define moving side walls of a mold cavity. The fusion-bonded matrix (or reticulum) coating provides advantageous accessible porosity throughout the coating and comprises a nonmetallic refractory material interspersed substantially uniformly throughout a matrix of heat-resistant metal or metal alloy, for example, nickel or nickel alloy, such metal or metal alloy being fushion-bonded to a grit-blasted surface of the belt and serving to anchor and hold the nonmetallic material. The coating is applied by thermally spraying a powdered mixture directly on the roughened surface. The result is to insulate and protect the underlying belt from intimate molten metal contact, from heat stress and consequent distortion and from chemical or stress-corrosive action by the molten metal or its oxides or slags. The nonmetallic material may be present, at least partly, in the form of isolated particles encased within the metallic reticulum and/or in the form of a second reticulum intertwined with the metallic reticulum. The life of the coated belts is dramatically increased, and the surface quality and properties of the cast product are significantly improved. The coating controls and renders more uniform the rate of freezing of the metal being cast, resulting in improved metallurgical properties.

Formulations and a method of forming such coatings by thermal spraying are described.

BRIEF DESCRIPTION OF THE DRAWINGS

FIG. 6 illustrates an improvement with respect to the belt-coating machines shown in FIGS. 3 and 5.

BEST MODE FOR CARRYING OUT THE INVENTION

Figure 1:
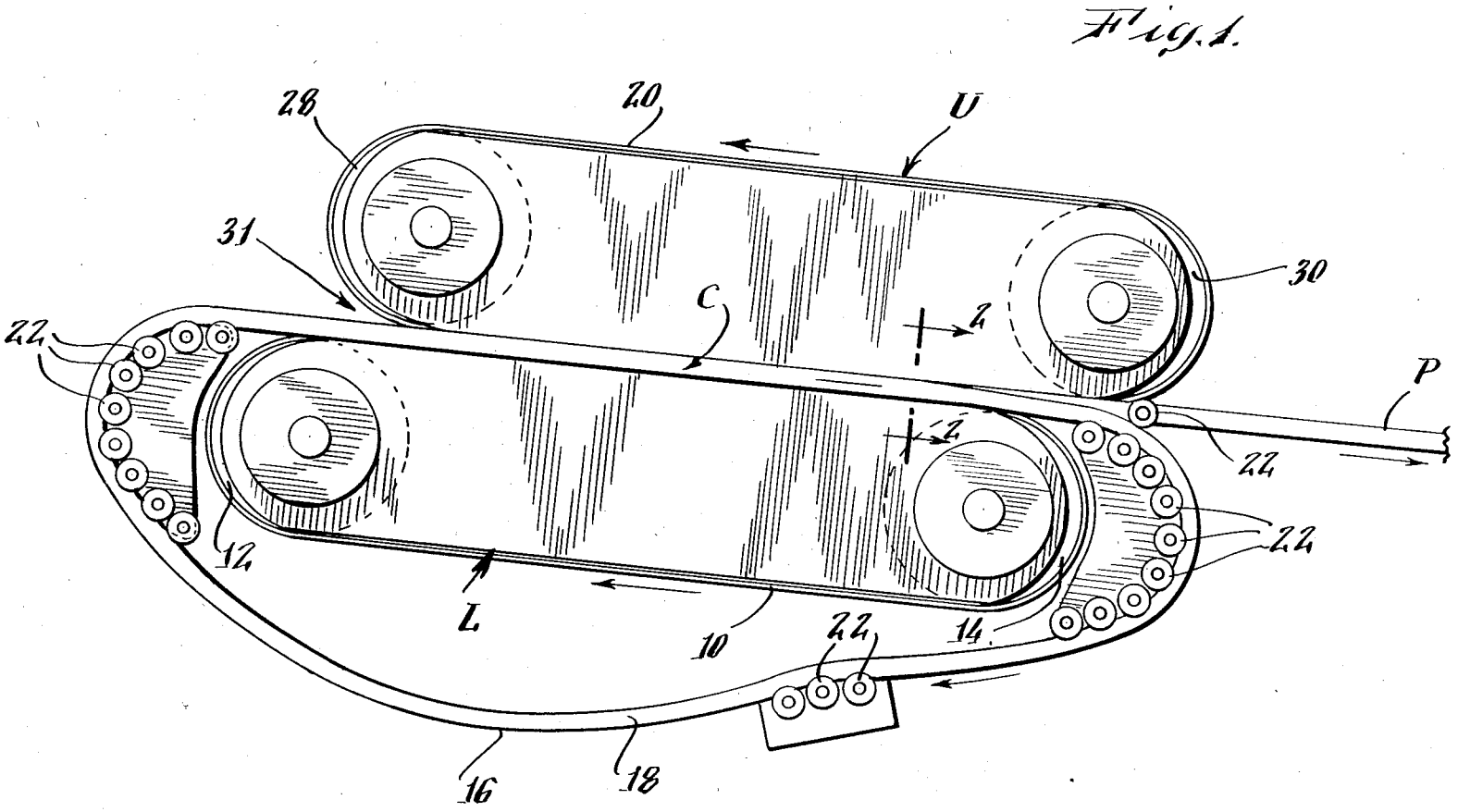
FIG. 1 illustrates a side view of the casting zone, the casting belts and pulleys, and one of the casting side dams of a twin-belt continuous casting machine.
Figure 2:
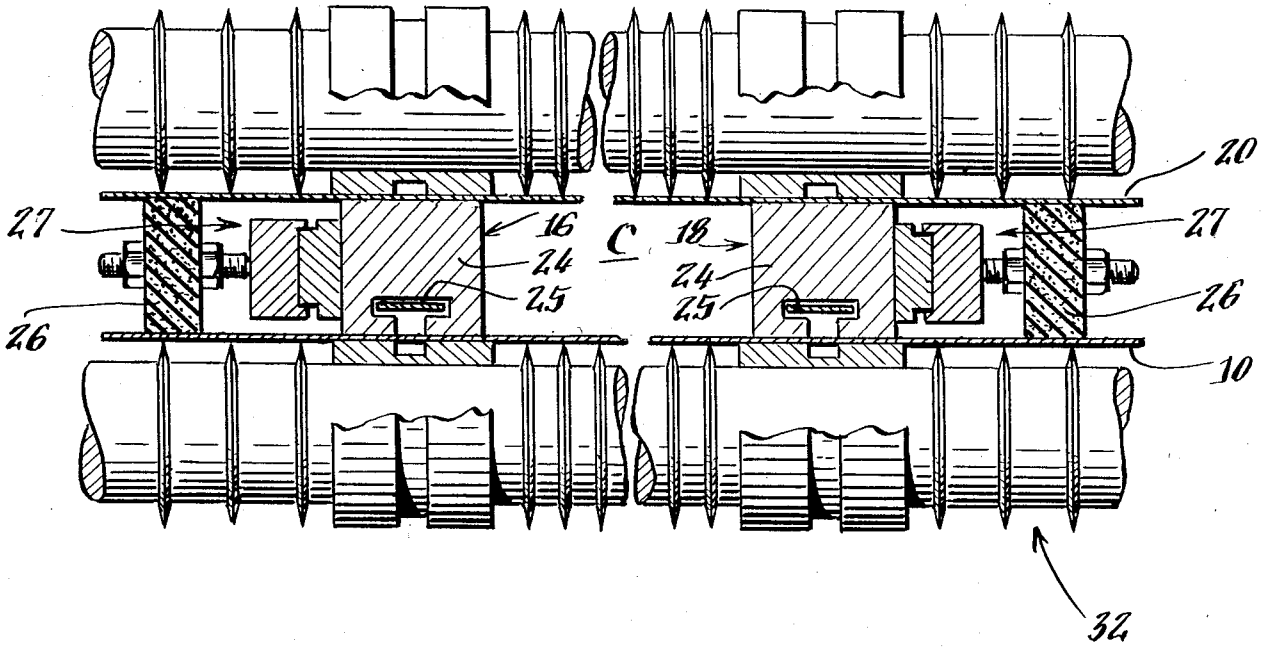
FIG. 2 is an enlarged cross-sectional view of the casting space and its surrounding parts, taken along the line 2—2 of FIG. 1.

With reference to FIGS. 1 and 2, there is illustrated the casting zone and nearby components of a twin-belt casting machine which includes a lower casting belt 10 revolved around pulleys 12 and 14, which are parts associated with a lower carriage L. Pulley 12 is located at the input or upstream end of the machine, and pulley 14 is at the output or downstream end of the machine. A continuous moving casting mold C is defined by and between the lower casting belt 10 cooperating with a pair of spaced casting side dams 16 and 18 (FIG. 2) and with an upper casting belt 20, as they move together along the casting zone C. The side dams are guided by rollers 22. They each comprise a multiplicity of slotted dam blocks 24 strung on straps 25. Seals 26 keep water from entering between the belts so as to isolate the casting region C from water. Stationary guides 27 serve to guide the moving side dams. Upper casting belt 20 revolves around pulleys 28 and 30, which are parts of an upper carriage U. Finned backup rollers 32 define the position of the belts in casting zone C and permit fast-moving liquid coolant to travel along the reverse surface of each belt. Molten metal is introduced into the machine at its upstream end as indicated by the arrow 31 in FIG. 1. The cast product P issues from the downstream end.

In accordance with the present invention each of the belts 10 and 20 is coated before being installed on the respective belt carriages L and U. It will be understood from FIGS. 1 and 2 that the molten-metal-contacting surface of each belt is its outer surface, sometimes called its front surface, while its inner surface is sometimes called the reverse surface. Such flexible casting belts 10 and 20 are usually made from low carbon steel rolled to be moderately hard and usually have a thickness in the range from 0.035 of an inch up to 0.065 of an inch, but thinner or thicker belts may be used. Occasionally, for more demanding service, the belts are made from a titanium-containing steel, as described in Dompas U.S. Pat. No. 4,092,155, which is work-hardened by rolling sufficiently to become full hard.

To coat a casting belt, such as belt 10 or 20, in accordance with the invention, any oily residue on the outer surface of the belt must first be thoroughly removed, as by alkali-detergent cleaning followed by wiping with a clean solvent.

Next, the outer surface of the belt is roughened by grit-blasting. For example, this grit-blasting is carried out with 20-grit aluminum oxide, applied at an air pressure between about 40 and 100 psi (between about 300 and 700 kilopascals). The size 20-grit means particles of aluminum oxide which have passed through a screen having 20 wires per inch. Air pressure within the lower portion of this range is used when grit-blasting thinner belts in the lower portion of the belt thickness range described above, since the impacts of the grit may otherwise cause roughness on the reverse belt surface. Air pressure within the lower portion of the range may also be advisable when the belt is not intended to be subsequently roller-stretcher leveled. Usually, the belt will be roller-stretcher leveled after grit-blasting in order to control distortion within acceptable limits, as described below. Roughness of the blasted surface is normally in a preferred range from 0.002 of an inch up to 0.003 of an inch (2000 to 3000 micro-inches or 52 to 76 micrometers), which range is readily obtained, though the useful range of roughness may occasionally extend from about 0.001 of an inch up to about 0.005 of an inch.

Surface roughness figures as stated above are determined as measured by our preferred method, that of the method of surface grinding. In this preferred method, the thickness of a blasted belt sample is first measured by means of an ordinary machinist's micrometer caliper. The sample is then placed on the magnetic chuck of a surface grinder, and the roughness is carefully ground off to just that level at which the resulting ground surface appears smooth. The belt sample is then again measured with the micrometer caliper, and the difference in readings is taken as the roughness. By comparison, the extremes of roughness of a given grit-blasted surface as measured by a vertically measuring microscope at 400X are, in our experience, on the order of 150% of the measured values obtained by the surface grinding and micrometer method.

The grit-blasting process ordinarily distorts the belt, and roller-stretcher belt leveling will usually be required. Leveling is done by passing the belt with reversals in bending and ironing action through multiple closely spaced rollers, for example, as shown and described in U.S. Pat. No. 2,904,860 of C. W. Hazelett.

Thermal spraying is the utilized to apply the one-coat fusion-bonded matrix protective insulative coating directly to the grit-blasted roughened belt surface. A successful method is to thermally spray the coating materials by means of a combustion flame—an oxyacetylene flame—at a standoff distance of at least 3 inches (76 mm) but preferably about 5 inches (127 mm), and at a traverse speed in the range of 30 to 50 feet (9 to 15 meters) per minute.

Oxyacetylene-sprayed coatings are successful if the material being sprayed does not burn up excessively in the flame.

Oversize nonmetallic particles may not entirely melt. Moreover, oxyacetylene flame may not be sufficient to retain nonmetallic particles molten for the time required to fuse them to other particles of the same species as finally deposited on the belt surface. If there is a preponderance of metallic particles intermixed with nonmetallics, the environment is not conducive for interfusion of the nonmetallic constituents. Thus, in such cases, the nonmetallic material may be present, at least partly, in the form of isolated particles encased within or surrounded by the metallic reticulum.

Plasma spraying is an alternative method of thermal spraying that uses electricity. Combustion (oxyacetylene) spraying is often called flame spraying. Such usage is apt to be confusing in that the plasma spray is often said to utilize a plasma flame. Both kinds of spraying may be said to utilize a flame. It is our terminology to use the phrase "thermal spraying" as being inclusive of both oxyacetylene flame spraying and electrically energized plasma spraying. Plasma spraying as ordinarily used runs hotter than oxyacetylene spraying and so results in less porosity.

It is our present belief that the higher temperatures provided by electrically energized (plasma) spraying may enable the rapid fusing of metallic and nonmetallic materials supplied in coarse forms, such as sticks, rods or wires (as distinct from powdered form) and therefore may enable such coarse forms of metallic and nonmetallic materials to be employed. But regardless of whether this belief proves true in practice, the use of mixtures of appropriate metallic and nonmagnetic constituents as described further below is dramatically successful in providing fusion-bonded matrix coatings with suitable percentages of "accessible" porosity as described hereinafter.

In most prior applications of thermal spraying, porosity is avoided so far as possible. In the present invention we have found the opposite to be true. Controlled porosity characteristics in the fusion-bonded matrix coat are desirable and important. An appropriate level of controlled porosity contributes substantially to the insulative value of the matrix coating, while at the same time an appropriate level of porosity enhances the desired characteristic of non-wettability by molten metal. We believe that this non-wetting enhancement is due in large part to the air retained in the pores of the porous coating. When molten metal is introduced adjacent to the coated belt, the air in the pores is heated and expands out of the pores and so supplies a gaseous film between the molten metal and the belt coating, thereby preventing the molten metal from wetting the coated belt, during the critical initial time when a skin of solidified metal is being formed on the product being cast in the continuous casting process.

Equally important is the fact that controlled porosity within the matrix coating has the virtue of acting as a blotter or disperser for moisture picked up on the surface of a casting belt, caused by condensation or by stray droplets of coolant. This blotting or dispersing of moisture prevents blowholes, rosettes, or needles that would otherwise appear in the surface of the cast product P adjacent to the location of a liquid contaminant. This feature of blotting dispersion of moisture is important, for example, in the casting of aluminum sheet product P with a high quality surface suitable for anodization, as opposed to lower surface quality which is acceptable for painting.

In addition, there are two more reasons why controlled porosity is desirable. One is its improvement of thermal shock resistance. The other is its increasing of resistance to spalling under mechanical rough handling. Both of these characteristics are important in a coating consisting, on a volume basis, largely of ceramic material or brittle material generally. Under thermal shock, the porosity appears to allow internal adjustments to occur without relatively massive dislocations appearing, there being already countless tiny dislocations present as pores, each of which we now believe contributes minutely to a myriad of needed internal mechanical adjustments for accommodating thermal shocks and mechanical flexings and stretchings. Thus, controlled porosity, far from detracting from effective strength of the matrix coating, actually increases it.

The desired porosity appears to extend throughout the unitary-layer, fusion-bonded matrix coating. That this porosity extends omnipresently throughout the matrix coating is evidenced by the fact that a steel belt so coated will rust if left moist.

In sum, substantial but controlled porosity within the unitary-layer, fusion-bonded matrix coatings on belts of continuous casting machines in accordance with this invention has four advantages that are important to the present invention. There are upper limits to the desired range of such omnipresent porosity. The upper limit in a given formulation is reached when the integrity of the coating becomes impaired. In those matrix coatings where the metallic constituents are predominant (as determined by weight), this upper limit is at least about 35 percent "accessible" porosity by volume. In those matrix coatings where the nonmetallic constituents are predominant (as determined by weight) this upper limit is about 12 to 20% "accessible" porosity by volume.

There is a lower limit to the desired range of "accessible" porosity by volume in the matrix coating, because insufficient porosity will not yield the four advantages described above. This lower limit is about 4 to 8%.

As described below, tests and mesaurements were made of "accessible" void space, i.e. effective porosity, as a percentage of the volume of the matrix coating. These tests and measurements were conducted to give a better understanding of the parameters contributing to the desired porosity. Samples, usually of about 14 square inches of mild steel belt stock, were thermally sprayed to a thickness usually of about 0.050 inch (1.3 mm). They were thermally dried and then weighed. Then they were soaked briefly in water with detergent (Kodak Photo-Flo) added; then they were withdrawn and all unabsorbed water was wiped off. The specimen was weighed again, the increase in grams noted and divided by the coating volume in cubic centimeters to obtain the percentage of void space that was accessible to water, which had become blotted or absorbed within the coating. In a given sample there may be other voids that are closed and so not measurable by this water-absorption method, but we believe that those "accessible" voids which emit gas on heating and which absorb stray water are the more important voids with respect to overall advantageous performance of the matrix coating during casting. Hence, a method of measuring effective porosity which takes into account only fluid-accessible or, specifically, water-accessible porosity is especially suitable to our purposes.

Table A below lists the water-accessible porosities as a percentage of the total volume of the matrix coating which were observed by measuring various test samples thermal spray coated with powdered mixtures of the listed formulations under the conditions stated.

TABLE A

WATER-ACCESSIBLE POROSITIES OF VARIOUS THERMALLY SPRAYED COATINGS
Oxyacetylene flame sprayed, except as noted.
Standoff distance of 5 inches, except as noted.
Traverse speed approximately 40 feet per minute.

| Composition % by weight: | Accessible Porosity: |
|---|---|
| a 56 Ni—19 graphite—25 $ZrO_2$ | 32 percent |
| b Same, sprayed at 10 inches | 34 percent |
| c 75 Ni—25 C (graphite) pellets | 30 percent |
| d 85 Ni—15 C (graphite) pellets | 14 percent |
| e 87 Ni—8 Al—5 Mo | 8 percent |
| f 60 Ni—6 Al—4 Mo—30 $ZrO_2$ | 4 percent |
| g 72 Ni—13 graphite—15 $ZrO_2$ | 14 percent |
| h Zirconia | 12 percent |
| i Zirconia, plasma sprayed | less than 2 percent |

COATING COMPOSITION

The preferred unitary-layer, fusion-bonded, protective matrix coating is of the same composition throughout its thickness. This matrix coating comprises a nonmetallic refractory material interspersed substantially uniformly throughout a matrix of heat-resistant metallic component or constituent. This metallic constituent is a metal or a metal alloy, and it must exhibit five critical properties, as follows:

(1) The metallic constituent must have heat resistance and resistance to thermal cycling. In other words, the metallic constituent must have a sufficiently high melting point relative to the temperature of the molten metal being cast that the metallic constituent resists undue degradation during the lifetime of the belt in continuous casting and also must resist undue deterioration due to the extreme and repeated thermal cycling which occurs during continuous casting. The melting point of the metallic constituent must be at least close to, but not necessarily above, the temperature at which the molten metal enters the continuous casting machine.

(2) The metallic constituent must have thermal fusion bonding compatibility with the flexible steel casting belts normally used to which the matrix coating is fusion-bonded.

(3) The metallic constituent must have at least a modicum of ductility in order to withstand the mechanical rough handling to which the matrix-coated belt is subjected during continuous casting. The moving belt is repeatedly flexed around pulley rolls and straightened out, and in addition the moving belt is subjected to a relatively high tension stress during use.

(4) The metallic constituent must have thermal expansion rates that are not too far different from the thermal expansion rates of the nonmetallic constituents included in the matrix coating to withstand repeated extreme thermal cycling occurring during continuous casting without flakes spalling off.

(5) The metallic constituent must have sufficient resistance to oxidation under the conditions of thermal spraying and also under the conditions of continuous casting so as to avoid undue deleterious oxidation.

We have found that nickel and nickel alloys are especially suitable for forming the metallic constituents of the matrix coatings of this invention. Cobalt, iron and titanium would also appear to have the hereinbefore described five critical properties so as to be useful as the metal or metal alloy for forming the metallic constituents of the matrix coatings. Those skilled in the art may find that other metals or metal alloys are also suitably operable.

The matrix coating of this invention is formed by thermal spraying of the metallic and nonmetallic constituents mixed in formulations within the following ranges:

Metallic constituents: about 38 to about 90 percent by weight,

Nonmetallic constituents: about 62 to about 10 percent by weight.

Our observations have led us to conclude that there must be a sufficient volume of the metallic constituents present in the matrix coating relative to the nonmetallic constituents so as to form an integral, fused network, reticulum or matrix of the metallic constituents for suitably holding or anchoring the nonmetallic constituents to the belt. Nonmetallic constituents, when present in the upper portion of the above range, may also form a network or reticulum entwined (intertwined) throughout the metallic reticulum. Nonmetallic constituents, when present in the lower portion of the above range, may be present, at least partly, in the form of isolated particles encased within or surrounded by the metallic reticulum. Thus, the metallic component forms the anchoring and holding matrix or reticulum, while the nonmetallic component is distributed uniformly throughout this reticulum either as a second reticulum or as discrete particles. The metallic constituent generally has a specific gravity averaging about one and one-half to about four times that of the nonmetallic. Thus, when both constituents are present in the coating at 50% by weight, the volume ratio of nonmetallic particles to metallic particles is about 2.5 to 1 in our usual formulations. On the other hand, when the metallic constituent comprises 85% by weight of the coating composition, then the volume ratio of nonmetallics to metallics is about 1 to 2.5.

Presently preferred compositions utilize at least as part of the metallic and nonmetallic constituents a composite nickel and graphite powder in which grains of nickel encapsulate graphite powder, the graphite comprising either about 15 or about 25 percent of the combined weight. Such composite nickel and graphite powders are available commercially, for example from Bay State Abrasives of Westborough, Mass.

Preliminary tests in the pouring of mild (1010) steel melting at about 1530° C. (2786° F.) onto steel casting belt samples having fusion-bonded matrix coatings in accord with the present invention have shown that commercially available, predominantly nickel alloy containing about 8 percent of aluminum and about 5 percent of molybdenum is a suitable metallic alloy for use with powdered zirconia or graphite as suitable nonmetallic constituents for forming a durable matrix coating.

Other metals, alloys, or nonmetallic refractories for example, silica or alumina could be suitable as constituents in the fusion-bonded, accessible-porosity, matrix coating provided by the present invention. The critical properties to be looked for in metals and alloys are set forth explicitly in greater detail above. They have suitable heat resistance and resistance to thermal cycling, bonding compatibility with low-carbon steel belts, a modicum of ductility, thermal expansion rates that are not too far different from those of the nonmetallic constituents included, and oxidation resistance if oxyacetylene flame spraying is to be the method of application.

A presently preferred insulative material for use at least as part of the nonmetallic constituent is zirconium oxide, $ZrO_2$, also called zirconia, which is used in powdered form, preferably of particle size running from 0.0005 to 0.0014 of an inch (12 to 36 micrometers). This zirconia nonmetallic constituent has the advantage that its coefficient of expansion more closely approximates that of steel and nickel than some other available metallic oxides which have a lower coefficient of expansion.

Yttria (yttrium oxide, $Y_2O_3$) added in any of various amounts up to about 20 percent may be helpful in stabilizing the structure of the zirconia crystals exposed to high temperatures, thus preventing premature loosening of the crystalline particles due to subtle changes in mechanical proportions during thermal cycling. Other metallic oxides may also be used for this heat-stabilizing purpose, notably magnesia (MgO) and lime (CaO). The latter is economical and has afforded acceptable results in our experience. Thus, economical lime (calcium oxide) is presently preferred as a heat-stabilizing compound. It is normally an ingredient in purchased zirconia, comprising about 4 to 5 percent by weight of the zirconia.

The particles or powder of the nonmetallic component are thoroughly mixed and blended with the powdered metallic component, and the resulting mixture is thermal-sprayed directly onto the grit-blasted surface of the belt. Segregation of the mixed powders during application must be avoided.

As discussed earlier, coatings of zirconia alone or of other nonmetallic substances alone may under certain adverse conditions lose adhesion and release bits of the nonmetallic substance into the freezing metal product. This flake-off problem has been minimized or avoided in the matrix coatings of this invention by attention to the following factors. The zirconia powder is preferably of fine particle size, sufficiently fine to pass through a screen having 300 or more wires per inch. There should be enough metallic constituents in the powder mix to form on the belt an integral, fused-together network or reticulum that will securely anchor and hold the zirconia particles in a relatively discrete and discontinuous array and/or in a second reticulum which is intertwined with the metallic reticulum as described above.

Additionally, the finished unitary-layer, fusion-bonded, matrix coating should be brushed and dusted or vacuum cleaned before use.

Graphite is a highly heat-resistant separating agent which sublimes at about 3700° C. without melting. It is a useful nonmetallic constituent for the reason that it is non-wetting with respect to nearly all molten metals. Moreover, should particles of graphite get into the metallic product, its softness, friability, lubricity, and inertness forestall most of the problems associated with the incidental inclusion of foreign substances. Under the pressure of rolling or drawing, graphite particles break or divide into progressively finer particles.

Our experience has shown that when suitable powdered metallics and powdered nonmetallics are thoroughly mixed and blended together, some of the resulting mixtures (particularly those containing very fine particles) are apt not to flow freely and uniformly through the passages of a thermal-spray gun. The result is uneven coating. For producing a free-flowing powder blend in many cases, an addition to the powder blend of at least about 0.25 percent by weight of spherical fumed silica ($SiO_2$) particles as a lubricant has substantially enhanced flowing of the powder mixture and uniformity of thermal spray coating. The amount of this fumed silica lubricant is not critical, and good results have been obtained with most powder mixtures. A grade of 0.014 micro meter (14 millimicrons) fumed silica particles has been successful for producing a free-flowing powder blend. This size of 0.014 micro meter is less than a millionth of an inch and is a nominal size.

Examples of suitable formulations for forming the matrix coatings of this invention are set forth below.

EXAMPLE I

| Constituent: | Weight percent: |
|---|---|
| Metallic component: | |
| Aluminum | 4 to 5 |
| Molybdenum | 2 to 3 |
| Nickel, plus trace impurities | 55 to 57.5 |
| Nonmetallic component: | |
| Zirconia | 35 |
| Calcium oxide, in the zirconia | 1.5 to 2 |
| | 100% |

EXAMPLE II

| Constituent: | Weight percent: |
|---|---|
| Metallic component: | |
| Aluminum | 6 |
| Molybdenum | 4 |
| Nickel, plus trace impurities | 52 |
| Nonmetallic component: | |
| Zirconia | 22 to 23 |
| Calcium oxide, in the zirconia | 1 to 1.5 |
| Graphite | 13 to 14.8 |
| Spherical fumed silica | 0.2 to 0.5 |
| | 100% |

EXAMPLE III

| Constituent: | Weight percent: |
|---|---|
| Metallic component: | |
| Nickel, plus trace impurities: | 57 to 60 |
| Nonmetallic component: | |
| Zirconia | 25 to 28.8 |
| Calcium oxide, in the zirconia | 1 to 1.5 |
| Graphite | 13 to 15 |
| Spherical fumed silica | 0.2 to 0.5 |
| | 100% |

EXAMPLE IV

| Constituent: | Weight percent: |
|---|---|
| Metallic component: | |
| Chromium | 14 |
| Nickel, plus trace impurities | 54 |
| Nonmetallic component: | |
| Zirconia | 29.8 to 30.4 |
| Calcium oxide, in the zirconia | 1.4 to 1.6 |
| Spherical fumed silica | 0.2 to 0.6 |
| | 100% |

EXAMPLE V—VIII

Similar formulations for forming matrix coatings of this invention may be obtained by substituting cobalt partially or fully for a corresponding weight percent of nickel in the foregoing four Examples.

EXAMPLE IX

| Component: | Weight percent: |
|---|---|
| Metallic component: | 38 to 90 |
| Nonmetallic component | 62 to 10 |
| | 100% |
| Constituents of metallic component: | |
| Aluminum | 0 to 35 |
| Nickel, plus trace impurities | balance |
| Constituents of nonmetallic component: | |
| Graphite | 0 to 40 |
| Spherical fumed silica | 0.3 to 0.8 |
| Lime | 4 to 20 of the sum of Zirconia plus Lime |
| Zirconia | balance |
| | 100% |

In this Example IX, the weight percent of aluminum is shown in the range 0 to 35, but the upper end of this range is subject to the limitation that the ratio of aluminum to nickel does not significantly exceed a one-to-one atomic ratio. Since the ratio of the atomic weight of aluminum to that of nickel is about 46%, the weight percent of aluminum in the above Example does not significantly exceed about 46% of the weight percent of nickel in this formulation.

EXAMPLES X–XVII

Magnesium zirconate can be substituted partially or fully for both a corresponding weight percent of zirconia and its proportionate weight percent of the heat-stabilizing agent Calcium Oxide in each of the foregoing Examples I–IX.

EXAMPLES XIX–XXII

Formulations a, d, e and f of Table A above, each modified to include at least about 0.25% by weight of spherical fumed silica as a lubricant, are further Examples suitable for forming fusion-bonded matrix coatings on flexible casting belts.

The preferred minimum deposited thickness of the fusion-bonded matrix protective insulating coating for use on flexible metal continuous casting belts 10, 20 (FIG. 2) is about 0.002 inch (0.05 mm), said minimum measurement being the thickness over the generality of the peaks of the underlying grit-blasted belt surface, which is the way a magnetic thickness gauge normally measures. However, advantages may be obtained by using matrix coatings as thin as about 0.0015 inch (0.038 mm).

Thermally sprayed coatings even thinner than 0.002 of an inch (0.05 mm) appear to be useful in some applications where nonwetting is more important than thermal insulation. Thus, a lower practical limit to thickness is not readily apparent. For extra insulation, thicknesses of several times this amount of 0.002 of an inch will on occasion be useful, since the coating which is the subject of the present invention is rugged and can withstand much flexing around the pulleys (rolls) of a continuous casting machine. But, depending on the casting application, more thickness is not necessarily better, not on flexible belts and especially not in uses where coating-loss impurities could seriously interfere with the quality of the cast product, as in the continuous casting of copper wire bar intended for fine wire drawing. Thicknesses as great as 0.015 of an inch (0.4 mm) are readily produced and are rugged. However, the expense of such thick coatings is also a limiting factor.

The accuracy with which insulation can be applied and controlled with these thermally sprayed fusion-bonded matrix belt coatings is not only a desirable feature in itself but, further, it enables planned proportioning of insulation between belts 10, 20 and edge dams 16, 18. That is, it enables the attainment of optimum comparative heat flux density through the belts 10, 20 as compared to heat flux into the edge dams 16, 18. The accurate proportioning of the density of heat flux between the broad belt surfaces on the one hand, and the relatively narrower moving edge dams on the other, is of importance in producing cast slab of first-class metallurgical quality where the thickness is greater than ¼ of an inch (6 mm); see U.S. patent application, Ser. No. 493,359, filed May 10, 1983, the disclosure of which is incorporated herein by reference. The theory therein may explain the importance of proportioning the density of heat flux between the wide belt mold surfaces and the narrow edge dam mold surfaces.

To achieve such relative proportioning of heat extraction (heat flux), one may adjust the thickness of coatings on the belts as compared to that same coating composition on the blocks of the edge dams. Metals are usually better thermal conductors than non-metals; hence the ratio of metal to non-metal in the fusion-bonded matrix coating may be adjusted to control conductivity. For example, the thermal conductivity of nicrhome (80% Ni, 20% Cr by wt.) is on the order of about ten times that of zirconia. Again, the metallic constituents themselves in the matrix coatings can be selected according to thermal conductivity or insulative value, and adjusting the content of metals of relatively low thermal conductivity to the content of metals of higher thermal conductivity. The conductivity of nichrome is on the order of about one-fourth that of nickel or of some low alloys of nickel.

The present invention may be applied to edge-dam blocks in themselves, in order to achieve advantages generally similar to those attained with belts. However, in accordance with the above-noted patent application relating to the insulation of edge-dam blocks, more insulation will generally be required on the edge-dam blocks than on the adjacent casting belts. This difference will ordinarily be achieved through applying a greater thickness of thermally-sprayed, fusion-bonded matrix coating insulating material, though composition ratios for adjusting and proportioning heat flux may be used.

METHOD OF FORMING FUSION-BONDED MATRIX COATINGS ON BELTS

Figure 3:
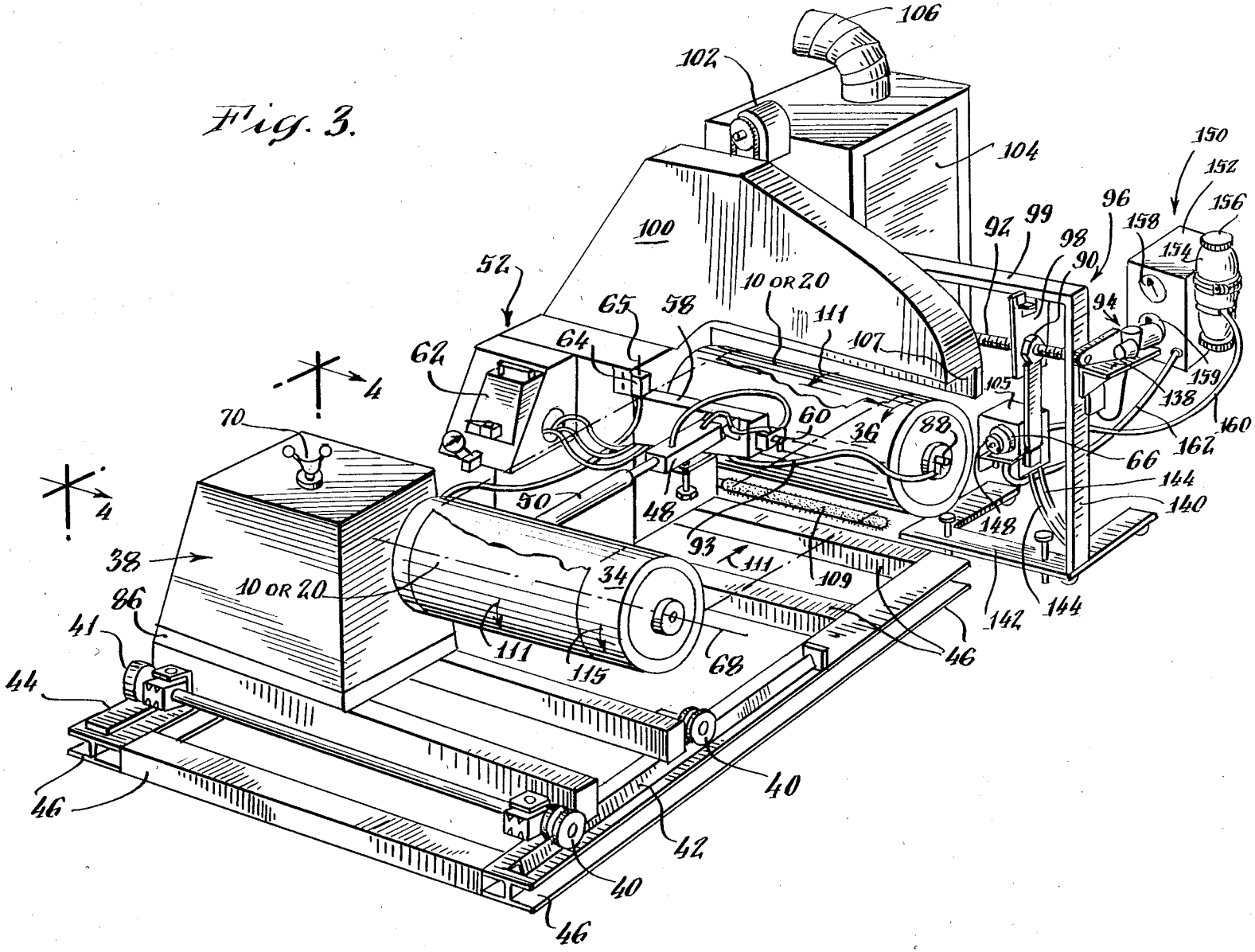
FIG. 3 is a perspective view of a belt coating machine as seen from the idling end.
Figure 4:
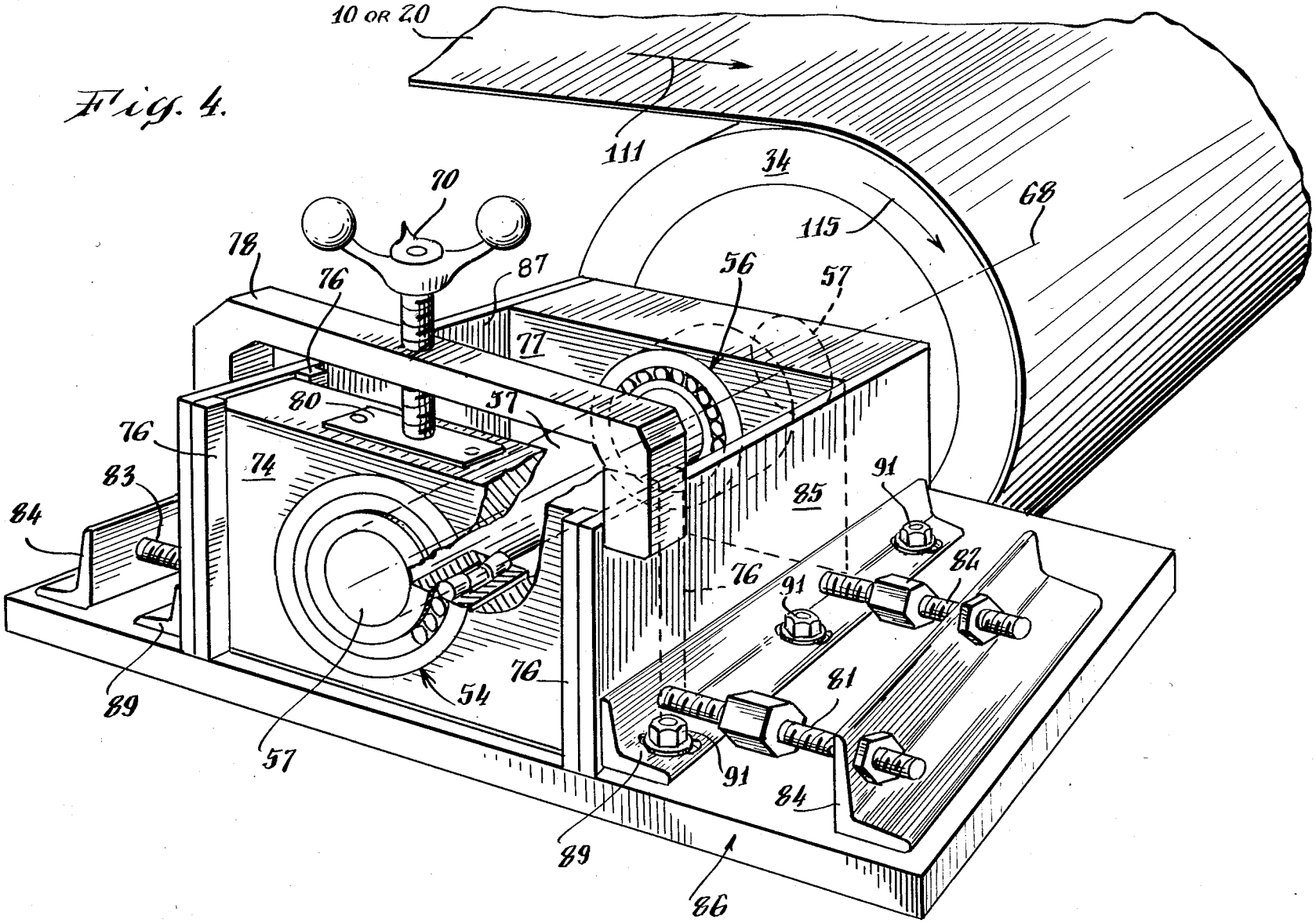
FIG. 4 is an enlarged perspective view of the steering mechanism portion of the belt coating machine of FIG. 3 as seen from the location 4—4 in FIG. 3.

A machine for employing the method for applying the coatings is illustrated in FIGS. 3 and 4. Two circular, cylindrical pulleys or rolls 34 and 36 have parallel horizontal axes. These parallel axes lie in the same horizontal plane, as a matter of convenience. The idler pulley 34 is mounted on its supporting pedestal 38 which is movable on wheels 40, 41 rolling on rails 42 and 44, to adjust for belts of differing lengths. The rail 42 is a steel angle with the legs downward, forming an inverted V, and the wheels 40 have peripheral grooves engaging the ridge of this rail. Rail 44 is a flat bar. The rails are mounted on bed structures 46. The rails are long enough to accomodate the longest belt which is to be coated.

The belt 10 to be coated is placed around these pulleys and tension is applied. The tension is exerted by a double-acting hydraulic cylinder 40, in line with a suitable rigid tubular spacer 50. This spacer 50 is removed and replaced with a longer or shorter spacer depending on each range of belt length to be coated. The cylinder 40 is mounted on the horizontal longitudinal centerline between the pulleys 34, 36 in order to avoid substantial turning torque on the idler pedestal and its supporting rails. This cylinder 48 is mounted on a rigid arm 58 projecting from a pedestal 52. The tubular spacer 50 is mounted on a similar rigid arm (not seen) projecting from the pedestal 38.

Since one side of the machine must be open for belt mounting and removal, the pulleys 34, 36 are cantilevered from pedestals 38 and 52, by means of two bearings 54 and 56 on each pulley shaft 57 to absorb the overhung load. We use a tension of roughly 2200 pounds (1000 kilograms) per reach of belt (upper and lower reaches), making a total force of 4400 pounds (2000 kilograms), though this tension force is not a critical factor, since the purposes of the tension are simply (1) to enable the driving and steering of the belt and (2) to force the belt to come close to the pulley 36 at the working end of the machine in order that the belt may be cooled where the thermal-spraying flame is to impinge on it. The side of the machine where the belts are inserted and removed is called the "outboard" side, and the side near the pedestals 38 and 52 is called the "inboard" side.

A four-way hydraulic valve 60 controls the tension. Hydraulic-oil under pressure comes from a pump 62. A limit switch 64 with an upstanding probe 65 senses the edge of the belt and causes a buzzer to sound a warning in the event that the belt creeps too far inboard, i.e., too close to the pedestal.

The belt 10 is ordinarily revolved relatively fast, while the traverse of a thermal-spray gun 66 is slow, resulting in a pattern of deposit path not unlike that of a screw thread or helix, with overlapping borders of the path. This helical application path is the preferred method, since the starting and stopping of the application can thus advantageously take place in the margins of the casting belt, outside of the casting area, where the location and effects of starting and stopping are not critical. The pulley 36 that supports the belt is revolved by means of a variable-speed drive (not shown) inside of the pedestal 52 at the working end, at a predetermined peripheral speed ordinarily between 30 to 50 feet (9 to 15 meters) per minute for oxyacetylene thermal spraying, and at 100 feet (30 meters), approximately, per minute for plasma thermal spraying. However, speeds well outside these suggested ranges may be suitable under some circumstances. For example, the thermal-spray gun 66 can conceivably be run back and forth rapidly across the belt like a shuttle, while the belt is rotated slowly or, preferably, the belt is stepped ahead with each pass of the "shuttle." But the attainment of uniform coating around the belt at the places of starting and stopping is not readily achievable by this shuttle method.

The presently preferred method involving relatively fast revolution of the belt as described above is apt to result in the belt creeping inboard or outboard on the pulleys, unless suitable adjustments or guides are available. The presently preferred adjustment for counteracting belt creep is that of skewing the cantilevered idler pulley 34 in a vertical plane, causing its axis 68 to be inclined a trifle upward or downward, within a plane perpendicular to the straight reaches of the belt. The mechanics of roll-skewing steering have been described in U.S. Pat. No. 3,123,874, which patent is incorporated herein by reference. For roll-skewing steering, the hand adjusting screw 70 is arranged to shift one bearing 54 upwardly or downwardly slightly for tilting the axis as needed to keep the belt from unduly creeping either way.

The details of the mounting of the idler pulley 34 are as follows. Inside the idler-pedestal housing 38, the moment from the tension of the belt on the cantilevered pulley 34 is absorbed from the pulley shaft 57 by the two self-aligning pulley shaft bearings 54 and 56. Bearing 54, the one nearest to the viewer of FIG. 4, is housed in a rectangular block 74 which is able to slide up and down between gibs 76. The weight of the cantilevered pulley 34 pivoting relative to bearing 56 fixed in a block 77 tends to raise the movable block 74, but the aforesaid hand adjusting screw 70, threaded into yoke 78, limits the rise of the block 74. Hardened wear plate 80 on top of the block 74 prevents galling at the end of the adjusting screw 70. The gibs 76 are mounted on pedestal frame plates 85 and 87 which are welded to the block 77. These plates 85 and 87 are also welded to the yoke 78 and to a pair of angle members 89. Alignment of the pulley axis 68 in a horizontal plane, i.e., in a plane parallel to the straight reaches of the belt is achieved through four adjusting screws (only three are seen) 81, 82, 83 threaded into solidly fixed angles 84, which in turn are anchored to a base plate 86, which is part of the pedestal 38. The angle members 89 on the plates 85 and 87 are adjustably secured to the base plate 86 by stud assemblies 91 including studs welded to the base plate and extending up through elongated slots in the flanges of the angle member 89, with a washer and nut on each stud.

The thermal-spraying gun 66 is mounted to aim at the belt 10 where the belt is passing around and is in contact with the pulley 36 at the working end of the machine. This pulley is cooled, which cooling is arranged by running water through it by means of axially mounted connections 88 (only one is seen) and a hose line 93. It may be expedient to cool both pulleys, but so far the idler pulley 34 has not been cooled. Cooling the working pulley 36 in this way keeps the pulley and also the belt from overheating.

Water which is cold and which is supplied in too large a flow rate will keep the working pulley 36 too cold resulting in condensation of atmospheric moisture as water on the belt. Such condensation interferes with the adherence of the sprayed material and must be avoided at all times. It is helpful to allow the cooling water to flow through the hose line 93 only when the pulley power is on. This control of water flow to occur only when the belt is revolving is arranged by placing a solenoid-controlled valve (not shown) in the line 93 which supplies the pulley-cooling water. This solenoid-controlled valve is energized from the same switch which energizes the pulley drive.

The thermal-spray gun 66 is made to traverse some or most of the width of a belt by means of a nut 90 engaging a lead screw 92 which is turned at a predetermined speed by an adjustable speed drive 94. This assembly 92, 94 is suspended from an upright rack 96, and the travelling nut 90 is guided by a carriage 98 travelling along a guideway 99, such as a guide bar. The preferred speed of traverse depends on the width of the spray which can be laid down in one pass, together with the speed of travel of the belt and the length of the belt as measured once around the loop. Naturally, a longer belt will take longer to pass once around the pulleys and so will require a slower traverse of the thermal spray gun 66 than a shorter belt. A typical range of traverse speed per belt revolution is ¾ to 1¼ inches (38 to 63 mm) per belt revolution, but a wide range of available traverse speeds should be provided for the gun 66. For instance, if the abovementioned plan of making a kind of "shuttle" of the flame-spray gun were to be adopted, traverse speeds of many feet per minute would be required. For such reasons, no hard and fast limits to the speeds of either belt revolution or gun traverse can be laid down.

The dust from overspray is efficiently collected. Incorporated within the machine are exhausting and washing equipment to catch this dust. Through a hood 100, which extends along near the work pulley 36 above the full length of the traverse of the gun 66, the air containing the oversprayed dust is sucked away by a suction blower driven by a motor 102. This air is blown through perforated, continuously wetted metal baffles located in a housing 104. The holes in these wetted baffles are as small as 1/16 of an inch (1.5 mm). The filtered and washed air is finally exhausted through a vent duct 106. The hood 100 has a lip 107 projecting down beyond the crown of the work roll 36. This downwardly projecting hood lip 107 is at a level just a few inches above the top of the housing 105 of the traversing thermal spray gun 66.

At the point of thermal-spray impingement, the belt may expand due to heating and bulge enough to lift away from the pulley 36, thus resulting in localized loss of contact between the belt and the cooled pulley 36. Such loss of cooling contact can result in localized over-heating of the belt.

An alternate method of cooling the belt is to sheath the periphery of the pulley 36 with a continually moistened jacket of moderately heat-resistant material, preferably somewhat resilient, such as a mat of silicone rubber or fiberglass mating, or a combination of such mat and matting. The objective is to present to the reverse side of the casting belt a textured or porous surface that will retain a controlled amount of cooling water or aqueous cooling liquid. A film of moisture so deposited on the reverse belt surface will cool and protect the belt from overheating. We believe that this cooling effect results largely from the water acting as a heat-transfer medium between the belt and the water-cooled pulley 36.

A presently preferred method of supplementing the belt-cooling by the cooled work pulley 36 is to use a wetted, mop-like cloth or fibrous mass 109 in contact with the belt and having a width about equal to the belt width. This wetted porous fibrous wiping mass 109 is placed in contact with the lower reach of the belt where the belt is approaching the work pulley 36, which is unsheathed steel. The direction of belt travel and pulley rotation are shown by the arrows 111 and 115 in FIGS. 3 and 4. Such fibrous belt-cooling devices 109 are continually moistened as needed in order to prevent the belt from reaching a temperature in excess of 450° F.

Figure 5:
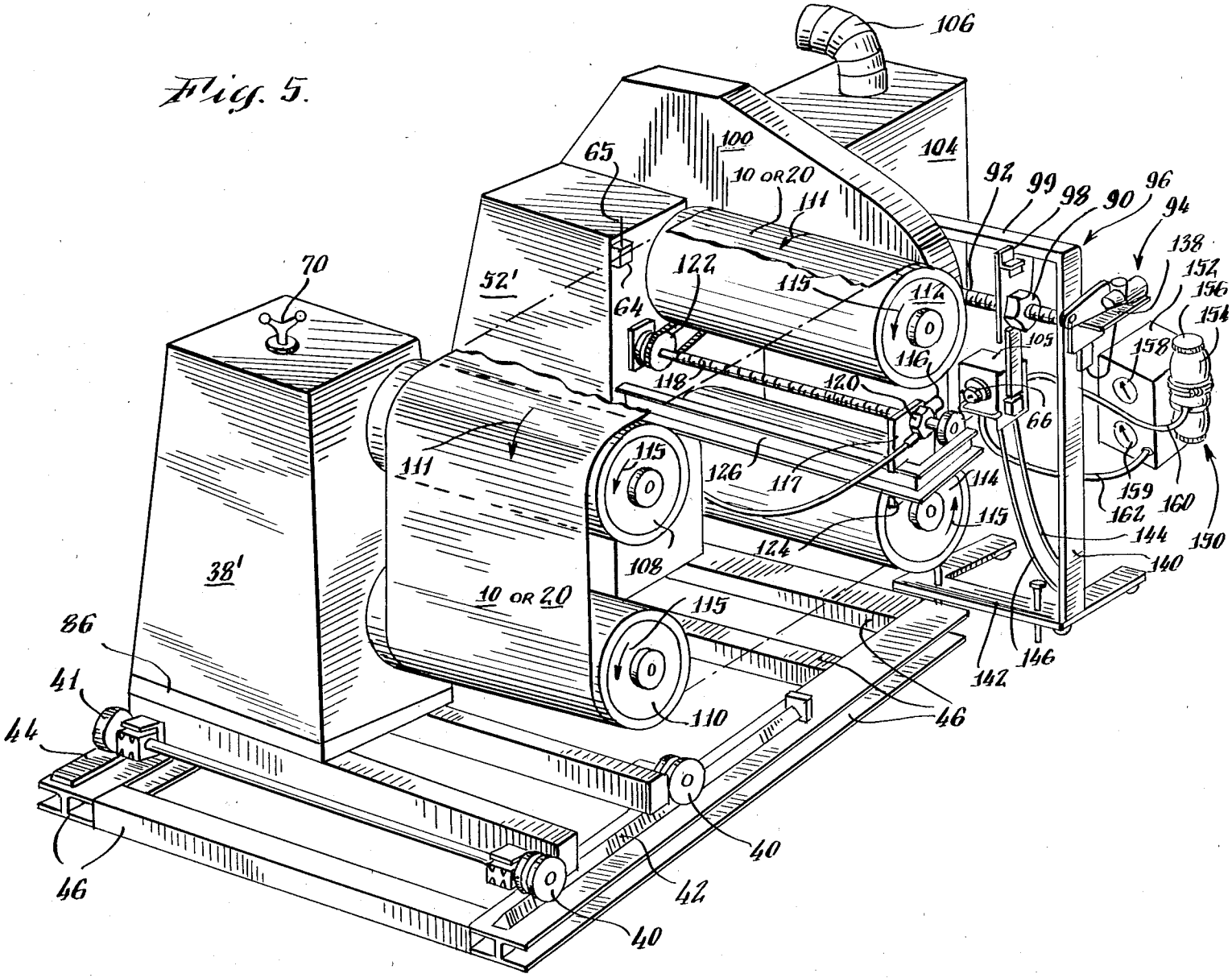
FIG. 5 is a perspective view of a modification of the machine of FIG. 3.

An alternate belt coating machine, a four-pulley machine, is shown in FIG. 5. This modification employs two idler pulleys 108, 110 extending from a pedestal 38' and a pair of work pulleys 112, 114 extending from a pedestal 52'. At least one of the pulleys 112, 114 is a drive pulley. This four-pulley machine may allow more reliable cooling of the belt at the point of thermal-spray impingement, since the coating is applied, not where the belt is in contact with a pulley, but on a flat portion of the casting belt accessible to other means of cooling from the reverse side, to a coolant, such as an aqueous liquid. Excess cooling, as by application of copious quantities of cold water, is not desirable, as there results condensation of atmospheric moisture on the side of the belt being flame-sprayed. Such condensed moisture interferes with adherence of the coating. Also, the disposition of excess water will be a problem, if sizeable quantities are used. Water cannot be allowed to contact the side of the belt being thermally sprayed.

For these reasons the water or aqueous liquid is preferably applied by a nozzle 116 making fine spray, or by a porous wiping device such as a wad or "muff" of fibrous, moderately heat-resistant material. Such a fine spray nozzle 116 or porous wiping mass or muff is acting upon the reverse surface of the belt preferably over a limited area being moved by a carriage 117 that is made to travel parallel to and in opposed aligned relationship with the thermal-spray gun 66 by means of a second screw 118, so as always to be opposite to the gun 66. The spray from the nozzle 116 should not be so fine as to create mist, unless a second suction hood is provided to prevent the mist from wandering to the front side of the belt. The carriage 117 for the nozzle 116 is mounted on a nut 120 which rides on screw 118, which in turn is driven by a chain sprocket 122, driven from the other screw shaft 92 for the gun 66 and synchronized with it so that the cooling means 116 always stays opposite to the traversing gun 66. A forked guide 124 sliding along a frame member 126 keeps the nozzle carriage 117 from rotating.

In this machine, four pulleys, not three, are generally necessary in order to provide a uniform belt steering effect at both ends of the machine. The steering method is similar in principle to that described in U.S. Pat. No. 3,310,849, which is incorporated herein by reference.

Inviting attention back to FIG. 3, we have found that the use of the wet, porous, wiping cooling mass 109 is very successful in avoiding any overheating of the belt. The work pulley 36 has a bare steel surface and is moderately cooled by a flow of water through the line 93 and connection 88. In addition, a film of water is applied to the inner belt surface by the wet, porous, fibrous mass 109. In order to achieve this thin, nicely spread water film on the reverse belt surface, liquid detergent is added as needed to the porous mass 109.

This system and method of using the wet, porous, belt-wiping mass 109 plus the moderately cooled bare work pulley 36 has recently been found to operate so successfully, that at present we believe this is the optimum arrangement.

The adjustable speed drive 94 includes an electric motor 128 (as seen most clearly in FIG. 6) driving an adjustable speed and reversible mechanical transmission 130, for example, such as a cone drive. A handle 132 is used to adjust the speed of the output and also to reverse the direction of the output drive. A dial 134 shows the adjusted speed and direction. This mechanical transmission 130 includes right-angle gearing, and the output from this transmission is a sprocket and chain drive 136 located within a protective housing and serving to drive a sprocket secured to the end of the leadscrew 92. Thus, the speed and direction of the leadscrew 92 can be adjusted by means of the handle 132. After an adjustment has been made, the leadscrew 92 turns constantly at the adjusted speed in the adjusted direction, until another adjustment is made. Such adjustable, reversible drives 94 are commecially available, for example, from Graham Company, of Milwaukee, Wis. In FIGS. 3 and 5, this drive 94 is shown mounted on a shelf 138 secured to an upright leg 140 of the stationary rack 96 which has a base frame 142.

The metallic and non-metallic powder constituents are thoroughly mixed by agitating impeller elements in a closed container with a removable cover, for example, the cover may be a screw-on, or latchable, top. The objective is to obtain thorough and uniform mixing and to prevent subsequent segregation before the mixture is fed into the powder feed passage leading to the nozzle of the thermal spraying gun 66. In FIGS. 3 and 5, this thermal spraying gun 66 is shown as an oxyacetylene flame gun to which the oxygen and acetylene are supplied through a pair of hose lines 144 and 146, respectively. The oxygen and acetylene are mixed within the gun 66 and are fed to an annular nozzle 148 having multiple orifices arranged around a forwardly aimed central axial outlet, with the powder mixture to be sprayed issuing from this axial outlet.

One way in which the powder may be fed to the gun 66 is to mount a hopper (not shown) onto the top of the gun housing 105. This hopper includes a closable cover and contains electrical motor-driven mixing agitator impeller elements for maintaining the powder thoroughly and uniformly mixed. The hopper walls may also be vibrated by an electrically energized vibrator for preventing "bridging" or compacting of the powder mixture within the hopper. A metering escapement mechanism serves to meter the flow of the powder mixture down from the bottom outlet of the hopper into the powder feed passage leading to the nozzle 148 of the gun 66, for example, this metering escapement may comprise a feed screw having an adjustable speed drive.

The presently preferred way in which the powder mixture is fed to the gun 66 is to use a remotely located powder mixing and feed apparatus, as shown at 150 in FIGS. 3 and 5. This apparatus includes a control console 152 and a container 154 which is loaded with the powder mixture by removing a screw-on cover 156. The powder composition is thoroughly mixed before loading into the container 154, and it is agitated and vibrated therein to prevent stratification, segregation, compacting or "bridging" within this container. The interior of this container 154 is adjustably pressurized by an inert gas, for example, such as nitrogen, with the container pressure being shown by a dial 158 on the console 152. Such pressure serves to propel the powder mixture toward an outlet from the container. This outlet communicates with a powder feed hose line 160 connected with the gun 66 and communicating with the axial passage leading to the central outlet of the nozzle 148. Increasing the container pressurization as shown by the dial 158 increases the powder feed rate, i.e. the quantity of powder mixture per minute being fed to the container outlet leading into the hose line 160. Conversely, decreasing the container pressurization decreases the powder feed rate.

The powder mixture velocity through the powder feed hose line 160 is controllable separately from the feed rate, and is indicated by a gas flow meter 159. This gas flow meter 159 indicates the velocity of the inert gas flowing through the powder feed line 160. This inert gas flow fluidizes the powder mixture adjacent to the container outlet and conveys the fluidized powder mixture through the line 160 to the central axial outlet in the nozzle 148 of the gun 66.

The oxygen and acetylene supply tanks (not shown) each has a conventional shut-off valve. There is a manually adjustable flow meter downstream from each shut off valve for independently adjusting the rate of feed of oxygen and acetylene through the respective lines 144 and 146. A manually operated valve at the gun 66 simultaneously turns "on" or "off" the flows through both of these lines 144 and 146. The gun 66 is manually ignited by a spark striker.

An electric switch at the gun 66 is connected through an electrical cable 162 with the control console for turning the mixing and feed apparatus 150 "on" or "off", as desired by the operator, who may be standing somewhat to the rear of the gun housing 105. Thus, the operator may turn "on" and ignite the gun. Then, when desired, the operator actuates the electric switch for causing the mixing and feed apparatus 150 to feed the powder mixture to the gun. An example of a suitable oxyacetylene flame spraying gun 66 and mixing and feed apparatus 150 is equipment which can be obtained commercially from Eutectic-Castolin Company, of Flushing, N.Y., under their trade name designation TERODYN System 3000. Another example of a suitable oxyacetylene flame spraying gun 66 and mixing and feed apparatus is an oxyacetylene flame spraying gun, as described previously, with hopper mixing and feeding apparatus mounted directly upon the gun housing 105. Such a hopper needs to be reloaded with the powder mixture at about ten-minute intervals during operation; whereas, the container 154 only needs to be reloaded with the powder mixture at about one-hour intervals during operation, and thus we presently prefer to use the remote apparatus 150.

As discussed previously, the belt 10 or 20 being coated tends to creep or "drift" sideways (edgewise) one way or the other during its revolving travel around the pulley rolls 34 and 36 (FIG. 3), or around the pulley rolls 108, 110, 112 and 114 (FIG. 5). Therefore, it is necessary to counteract the drift by steering the belt by turning the steering screw 70, as already explained. This sideways creeping or drifting of the belt and the counteracting steering action causes a problem with respect to the desired uniformity of the matrix coating being applied. If the thermal spray gun traverses uniformly constantly with respect to the frame of the coating machine, as the leadscrew 92 ordinarily constrains it to do, then some non-uniformity of the transverse motion of the gun with respect to the belt may occur. The result of such non-uniform relative motion between the gun and the belt is that more coating is deposited in some areas of the belt and less in others.

Figure 6:
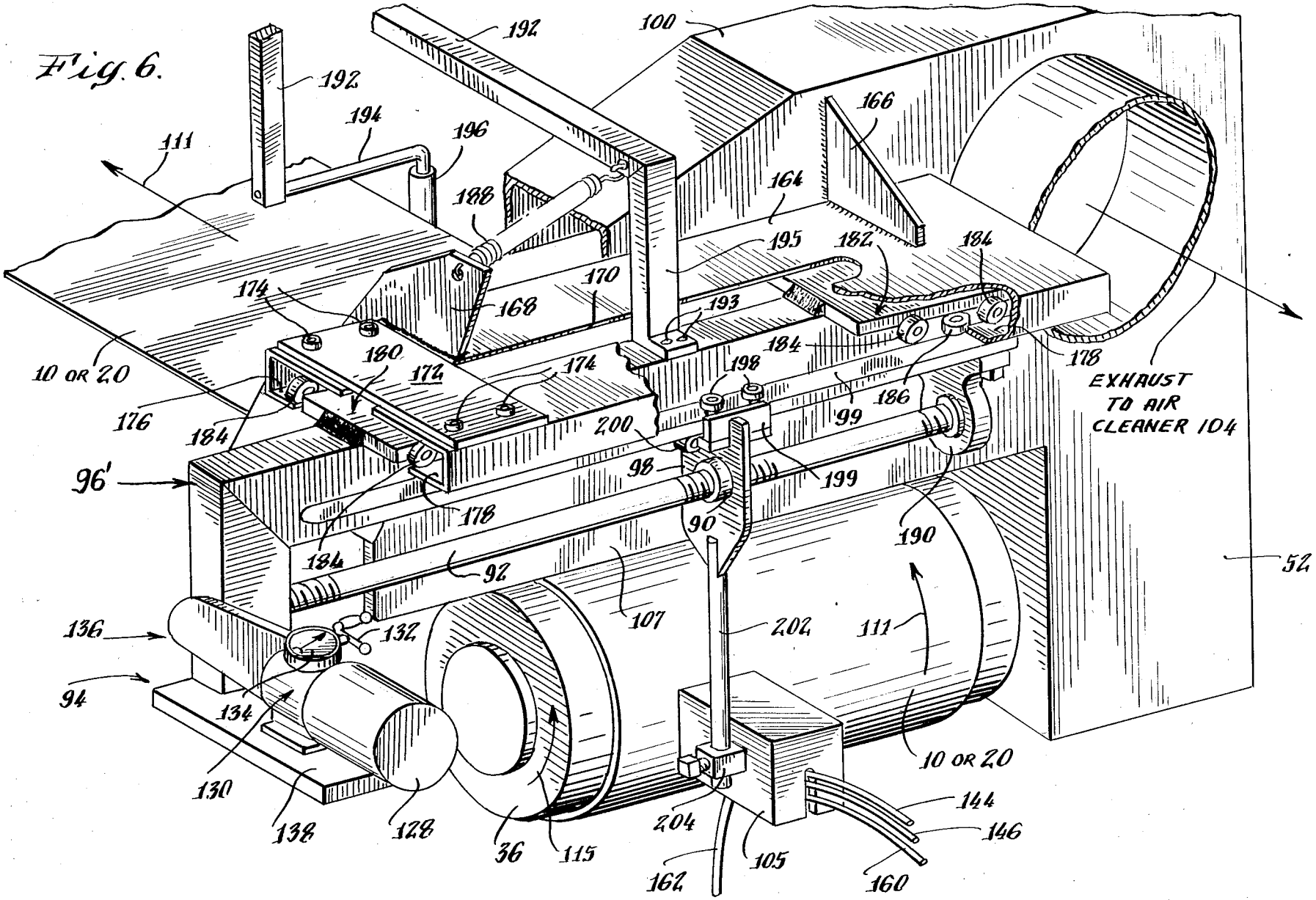
FIG. 6 is a perspective view, shown enlarged, of a preferred, laterally "floating" thermal spray gun assembly as seen looking from the working end of the belt-coating machine.

In order to cause the thermal spray gun to traverse constantly and consistently uniformly with respect to the belt 10 or 20 being coated, regardless of any sideways (edgewise) belt movement, the presently preferred apparatus and system, as shown in FIG. 6, is advantageously employed. The upright leg 140 of the rack 96, as shown in FIG. 3 or 5, is cut off below the level of the shelf 138, thereby creating a rack assembly 94' which is laterally "floating"; that is, which is free to move back and forth in a direction parallel with the axis of the leadscrew 92, in order to allow the gun to "track" any lateral (edgewise) motion of the belt, as will be explained. The entire thermal spraying apparatus is "floating" for accommodating lateral motion, including the leadscrew 92 and its drive 94 and their support frame 96', together with the thermal spray gun and its carriage 98. In other words, this "floating" allows the leadscrew and gun to be moved freely laterally with respect to the face of the casting belt being coated; that is, to be moved in a horizontal direction parallel to the axis of the leadscrew 92.

There is a stationary horizontal track frame 164 which extends parallel with the leadscrew 92 and also parallel with the axis of the work roll 36. This track frame 164 is supported and secured by brackets 166 and 168 to the stationary hood 100, for example, by welding attachment of these brackets. This track frame 164 has a generally hollow rectangular configuration as seen looking at its left end in FIG. 6. There is an elongated cut-out clearance opening or slot 170 in the upper surface of the track frame 164, and this elongated slot opening 170 extends to the left (outboard) end of the track frame. A removable plate 172 bridges the gap at the left end of the slot opening 170, being fastened by four machine screws, washers and nuts 174.

This track frame 164 has a pair of parallel inturned flange tracks 176 and 178 which are spaced apart and are located in the same horizontal plane for serving as trackways parallel with the axis of the leadscrew 92. Riding along these parallel trackways 176 and 178 are a pair of wheeled carriages 180 and 182 comprising plates welded to the top of the floating frame 96' and projecting out on both sides. Each carriage 180 and 182 has four supporting wheels 184 with horizontal axes in planes perpendicular to the axis of the leadscrew 92. There are two wheels 184 on each side of each carriage, so that each carriage has two wheels rolling along each trackway 176 and 178 for supporting the floating frame 96'.

In addition to these four supporting wheels 184, each carriage 180 and 182 has a guide wheel 186 with vertical axis. These guide wheels 186 are located below each carriage 180 and 182 for rolling along the edges of the respective trackways 176 and 178 for guiding the movable frame 96' for causing it to move parallel with respect to the face of the belt in the region being thermally sprayed by the gun.

It is noted that the inboard (right) end of the leadscrew 92 as seen in FIG. 6 is mounted in a bearing assembly 190 bolted to the lower surface of the movable frame 96'. The movable frame 96' ends just beyond the location of the bearing 190. Thus, seen as a whole, the movable frame 96' has an L-shape, with the longer shank of the L extending horizontally and with the shorter leg of the L extending down vertically, with the platform or shelf 138 secured to the lower ends of this vertical leg.

In order to track the edge of the belt 10 or 20 being coated, there is a tracking roller 196 having a vertical axis mounted on an arm member 194 carried by an inverted U-shaped support member 192 with a foot pad secured at 193 to the top of the movable frame 96' between the carriages 180 and 182. This inverted-U support member 192 has sufficient height and width to reach completely over and to clear the hood 100, in all positions, and its upstanding leg 195 extends up through the clearance slot opening 170. A tension spring 188 extends between the stationary bracket 168 and the support member 192, thereby urging the movable frame 96' toward the left (toward the outboard direction) for causing the tracking roller 196 to maintain contact with (and thus to follow) the inboard (right) edge of the belt.

Consequently, the thermal spraying assembly is caused by the spring 188 and the sensing roller 196 to track the belt regardless of any edgewise creeping or drifting of the belt as the belt revolves. If there were no turning of the leadscrew 92, then the path of thermal spraying on the belt surface would be aligned at a fixed distance from the sensed belt edge, regardless of any lateral (edgewise) movements of the belt.

Now, when the uniform leadscrew induced motion of the spray gun is superimposed on the aforesaid automatic tracking of the belt edge, the result is to produce a desired uniform coating action, regardless of any lateral (edgewise) movements of the belt in either direction. In other words, as the belt revolves and as the leadscrew 92 causes the gun to move relative to the floating frame 96', the resultant adjacent passes of thermal spraying are always at a uniform predetermined distance from each other blending into each other in predictable fashion on the belt surface, resulting in applying a coating of uniform thickness onto the belt, regardless of any lateral (edgewise) movements, i.e., regardless of any lateral wobbling, of the revolving belt.

This desired uniformity of application of the coating is advantageously achieved regardless of sideways drift of the belt or the steering of the belt in correcting such drift. This uniformity is also advantageously achieved regardless of any camber which may happen to exist in the belt edge, since all that is required of the adjacent passes of the spray is that they be of uniform predetermined distance from each other for appropriately blending, not necessarily that they be perfectly straight, i.e., that they lie in a perfect helical path on the belt surface.

In order to enable the fork-shaped gun carriage 98 to move accurately relative to the floating frame 96', this carriage 98 includes a chassis 199 on which are mounted a pair of wheels 198 having vertical axes. These wheels 198 roll along an accurately machined guide way or track 99 on the side of the horizontal leg of the movable frame 96'. A similar pair of wheels (not seen) on the other side of this chassis 199 roll along a similarly accurately machined guide way on the opposite side of the horizontal leg of this movable frame 96'. Thus, the wheels 198 of the carriage 98 are in straddling relationship with the frame 96' for holding the carriage 98 accurately aligned for holding the gun housing 105 accurately spaced from the belt surface as the leadscrew 92 rotates. Another pair of wheels 200 (only one is seen) mounted on opposite ends of the chassis 199 on horizontal axes roll along an accurately machined guideway on the under surface of the horizontal leg of the movable frame 96' for steadying the gun carriage 98 to prevent it from swaying. A strut 202 extends down from the carriage 98 and is adjustably secured at 204 to the side of the gun housing 105. In FIG. 6, the viewer sees the rear of the gun housing 105, for its nozzle is aimed at the belt.

Although FIG. 6 shows the thermal spray gun aimed at the belt as the belt passes around the roller 36, it is to be understood that this laterally-floating belt-tracking thermal spraying apparatus of FIG. 6 can also be employed advantageously with a four-pulley coating machine as is shown in FIG. 5.

It is to be understood that the roller 196 serves as a sensor of the belt edge location, and the spring 188 serves as motive means for moving the movable frame 96' in response to the sensing action of the roller 196. Other belt-edge sensor means, for example, such as sliders, electrical contacts, light beams and photoelectric cells, pneumatic or air jet position sensors, magnetic sensors and so forth, can be used in connection with other motive means for moving the frame 96', for example, such as electrical, pneumatic or hydraulic motive means in a servo loop control system responding to such sensor means, such servo loop control systems being well known to those in the field of machine motion control.

Moreover, instead of tracking the belt edge, it is possible to paint or apply a narrow strip of contrasting color along the margin of the belt near its edge and then to track such a strip.

However, the edge of a steel belt is very definitive by nature, and we have found this completely mechanical sensing and motive means for producing automatic belt tracking movement of the whole laterally-floating thermal spray assembly to be eminently practical and very reliable and durable.

RESULTS OF THE INVENTION

The present invention of thermally spraying a unitary-coat fusion-bonded matrix protective coating of powder mixture of heat-resistant metallic and refractory non-metallic components is capable of meeting all of the following essential or desirable conditions. The fusion-bonded matrix coating (1) is adherent to the flexible base metal of the belt or to edgedam blocks; (2) provides adequate thermal insulation; (3) is resistant to mechanical damage, —i.e., spalling flakeoff or abrasion; (4) is resistant to thermal shock; (5) affords an acceptable often attractive surface finish on the cast product; (6) is acceptably non-wetting with respect to molten metal cast; (8) affords accurate proportioning of insulation between the belts and the edge dams; (9) has desirable accessible porosity throughout the matrix coating; (10) is compatible, because of surface characteristics, with additional minimally applied temporary top-coatings, such as oil or graphite or a combination; and (11) can be applied practically by means of a readily constructed and readily operated machine as described.

In accordance with customary practice in using belt casting machines, the user may find it desirable or may wish to apply a temporary top coating over the fusion-bonded matrix coated belts. For example, a temporary coating of colloidal graphite applied and dried from an aqueous or solvent solution has been found suitable for use on such matrix coated belts for casting copper product P.

Judging from previous experience, we believe that amorphous carbon or soot, applied for instance as a colloidal suspension, may be substituted for the graphite topcoat.

In the case of casting aluminum slab as the product P, diatomaceous silica may be included in this temporary top-coating. In the casting of copper, a trace of oil appears to be desirable and may be sprayed onto the fusion-bonded matrix coating of a new belt in minute quantities, however not enough to appear wet or to result in any decomposition of the oil.

In the casting of copper bar to be used for drawing into wire, belt life top and bottom was increased by a margin of nearly 2 to 1, when the belts had been fusion-bonded matrix coated in accordance with this invention. Surface quality was remarkably improved, owing in part to the ability to use much less oil or top-coating than conventional practice, thus reducing its attendant hydrogen-related porosity in the cast product. Improved metallurgy of the copper rod indicated that improved drawability was present also.

In an early test of casting of copper bar, the matrix coating of Example I was used on a top belt 20 only. The thickness was around 0.002 of an inch on a hard-rolled, low-carbon titanium steel belt 0.044 of an inch thick. This cast was stopped after three hours, for reasons not related to the belt coating, which was still in excellent condition. No precoat of graphite was used at first, and a little pickup of copper was experienced. The next cast on this top belt ran 24 hours with two interruptions not related to the belt coating. The quantity of oil applied onto the belts was reduced as compared with conventional practice in casting copper bar in a twin-belt machine, with good results. The test was terminated after 24 hours due to reasons not related to the belt coating.

The above copper bar casting test was repeated with an Example I matrix coated low-carbon-steel upper belt 20 of No. 2 temper, no titanium content. The results were just as good as with the titanium-steel belt, and such good results were not expected, because such good results were contrary to previous experience in attempting to cast copper bar on such a non-titanium-containing steel belt. Prior experience had been that hairline cracks might be expected to occur in such a non-titanium-containing belt after 8 to 10 hours of repeated cyclic contact with molten copper and cyclic flexing. Such cracks did not appear in the matrix coated non-titanium-containing belt that was tested for eight to ten hours.

A further copper bar casting test was conducted with a fusion-bonded matrix coating according to Example III. This coating was applied onto low-carbon, hard-rolled titanium steel belts of 0.044 inch thickness. This time, such fusion-bonded matrix coated belts were used both as the top and bottom belts 20 and 10. Oil was lightly sprayed onto the bottom belt. After an initial light application of oil on the top belt, it was only necessary to wipe the top belt perhaps three times an hour, in order to dislodge slight pickup. Results were the best ever, including the longest belt life which we have seen for casting copper. Belt life, top and bottom, was increased by a margin of nearly 2 to 1.

An example of the benefits of the subject invention has been the experimental casting of aluminum alloys. Surface improvement of the metal being cast was remarkable. Rosettes and streaks formerly observable during the casting process were eliminated, on both the top and the bottom of the cast slab. Rejectable material was greatly reduced. The fusion-bonded matrix coated belts were still in good condition well beyond the useful life of conventional belts. The edges of the cast slabs were excellent, owing to the proportioned heat transfer between edges and belts by use of the insulative coatings.

In our experience, in order to operate advantageously in use, an endless flexible casting belt having a fusion-bonded matrix coating thereon in accordance with this invention will be capable of repeatedly flexing around a pulley roll having a diameter of 20 inches (508 mm) without occurrence of flaking or spalling of said coating.

Although the examples and observations stated herein have been the results of experimental field trials of belts matrix-coated, as described, on which were cast molten copper or molten aluminium and aluminum alloys, and tests with molten steel poured onto stationary sections of coated belt, allowing a vertical fall of fourteen inches before the molten steel impacted against the coated belt, this invention appears applicable to the continuous casting of any metal or alloy having a melting temperature equal to or less than steel.

Although specific presently preferred embodiments of the invention have been disclosed herein in detail, it is to be understood that these examples of the invention have been described for purposes of illustration. This disclosure is not to be construed as limiting the scope of the invention.

We claim:

1. The method of providing a protective, insulative coating on a metal surface of a continuous casting machine, such surface being intended to be subject to contact with molten metal during casting, comprising:

providing in readily heat fusible form metallic material having the properties of:

(a) heat resistance relative to the temperature of the molten metal being cast and resistance to thermal cycling, (b) thermal fusion bonding compatibility with such metal surface, (c) a modicum of ductility for withstanding repeated flexing around a pulley roll during casting, (d) sufficient resistance to oxidation under the conditions of thermal spraying and also under the conditions of continuous casting for avoiding undue oxidation, and (e) thermal expansion rates compatible with predetermined nonmetallic refractory material, providing in readily heat fusible form such nonmetallic refractory material, and thermally fusing to said metal surface a coating comprising said metallic material subsantially uniformly intermixed with said nonmetallic refractory material and thereby creating a desired accessible porosity of at least 4% of the total volume of the coating to enhance the non-wettability of the coating by molten-metal.

2. The method of claim 1, wherein said metallic material and said nonmetallic refractory matrial are reduced to powder and are substantially uniformly intermixed prior to fusing to said surfaces.

3. The method of claim 2, wherein said fusing step comprises thermal spraying.

4. The method of claim 3, wherein said metallic material includes nickel as the predominant constituent, and said thermal spraying is carried out at a standoff distance of at least 3 inches (76 mm) and at a traverse speed in the range of 30 to 50 feet per minute (9 to 15 meters per minute).

5. The method of claim 4, wherein said coating includes accessible porosity comprising at least about 8% of the total volume of the coating.

6. The method of claim 4, wherein said coating has a thickness in the range of from about 0.0015 of an inch (0.04 mm) to about 0.015 of an inch (0.4 mm).

7. The method of claim 4, wherein said coating has a matrix structure including a continuous reticulum of the metallic material, and the nonmetallic material is interspersed throughout this matrix.

8. The method of claim 2, wherein said nonmetallic refractory material comprises from about 10 to about 62% by weight of said coating.

9. The method of claim 2, wherein said metallic material comprises about 38 to about 90 percent by weight of said coating.

10. The method of claim 9, wherein the ratio of the specific gravity of metallic material to the non-metallic refractory material is in the range of from about 1½:1 to about 4:1.

11. The method of claim 9, wherein the metallic material is a metal or metal alloy in which the metal is selected from the group consisting of nickel, cobalt, iron and titanium.

12. The method of claim 11, wherein the nonmetallic refractory material is selected from the group consisting of graphite, zirconia, magnesium, zirconate, silica and alumina.

13. The method of claim 12, wherein the metallic material comprises nickel and the non-metallic refractory material comprises from about 15 to about 25 percent by weight.

14. The method of claim 12, wherein the nonmetallic refractory material is powdered zirconia having a particle size of from about 0.0005 to about 0.0014 of an inch (12 to 36 micrometers).

15. The method of claim 14, wherein the coating is fused to the metal surface of an endless flexible metallic casting belt.

16. The method of claim 12, wherein said substantially uniform mixture of metallic material and non-metallic refractory material has present therein a heat stabilizing amount of a heat stabilizing agent selected from the group consisting of yttria, magnesia and lime.

17. The method of claim 16, wherein the heat stabilizing agent is yttria in an amount up to about 20 percent by weight.

18. The method of claim 17, wherein the substantially uniform mixture of metallic material and non-metallic refractory material has present therein at least about 0.2 percent by weight of spherical fumed silica as a flow enhancing lubricant.

19. The method of claim 18, wherein the fumed silica have a particle size of about 0.014 micrometers (14 millimicrons) and is present in an amount of from about 0.2 to about 0.8 percent by weight.

20. The method of claim 19, wherein the coating is fused to the metal surface of an endless flexible metallic casting belt.

21. The method of claim 16, wherein the substantially uniform mixture of metallic material and non-metallic refractory material has present therein a flow enhancing amount of a lubricant material.

22. The method of claim 1, wherein said metallic material includes nickel as the predominant constituent, and said metallic material comprises from about 38 to about 90 percent by weight of said coating.

23. The method of claim 1, wherein said coating includes accessible porosity comprising at least about 8% of the total volume of the coating.

24. The method of claim 23, wherein said coating has a thickness in the range from about 0.0015 of an inch (0.04 mm) to about 0.015 of an inch (0.4 mm).

25. The method of claim 23, wherein said coating has a matrix structure including a continuous reticulum of the metallic material, and the nonmetallic material is interspersed throughout this matrix.

26. In a method for coating a metal surface of a continuous casting machine according to claim 1 the further step of relative proportioning of the density of heat flux between belt surfaces on the one hand and edge dams on the other hand in a machine for continuously casting metal product directly from molten-metal, wherein the molten-metal is introduced into a moving mold of said machine, said moving mold being defined above and below by upper and lower matrix coated endless flexible metallic belts and being laterally defined by first and second matrix coated edge dams mainly metallic, and matrix coated endless flexible belts and edge dams being coated with a matrix coating, said proportioning comprising:

determining the density of heat flux through the said belts and proportioning said heat flux in relation to the density of heat flux into the said edge dams by adjusting the relative thickness of the matrix coatings applied on the belts as compared to the thickness of the matrix coatings applied on the edge dams.

27. In a method for coating a metal surface of a continuous casting machine according to claim 1 the further step of relative proportioning of the density of heat flux between belt surfaces on the one hand and edge dams on the other hand in a machine for continuously casting metal product directly from molten-metal, wherein the molten-metal is introduced into a moving mold of said machine, said moving mold being defined above and below by upper and lower matrix coated endless flexible metallic belts and being laterally defined by first and second matrix coated edge dams mainly metallic, said matrix coated endless flexible belts and edge dams being coated with a matrix coating, said proportioning comprising:

determining the density of heat flux through the said belts and proportioning said heat flux in relation to the density of heat flux into the said edge dams by adjusting within at least one of the matrix coatings the ratio of metallic content to nonmetallic content.

28. In a method for coating a metal surface of a continuous casting machine according to claim 1 the further step of relative proportioning of the density of heat flux between belt surfaces on the one hand and edge dams on the other hand in a machine for continuously casting metal product directly from molten-metal, wherein the molten-metal is introduced into a moving mold of said machine, said moving mold being defined above and below by upper and lower matrix coated endless flexible metallic belts and being laterally defined by first and second matrix coated edge dams mainly metallic, said matrix coated endless flexible belts and edge dams being coated with a matrix coating, said proportioning comprising:

determining the density of heat flux through the said belts and proportioning said heat flux in relation to the density of heat flux into the said edge dams by adjusting within at least one of the matrix coatings the content of at least one metal of relatively low thermal conductivity relative to the content of at least one metal of higher thermal conductivity.

29. An endless flexible casting belt for use in a continuous metal casting machine for continuously casting molten-metal, said belt having fusion-bonded to a surface thereof a protective, insulative coating comprising:

a metallic material, a nonmetallic refractory material substantially uniformly interspersed throughout said metallic material, and said metallic material being in the form of a matrix holding, supporting and anchoring said nonmetallic refractory material on the belt surface, said coating having a desired accessible porosity of at least 6% of the total volume of the coating to enhance the non-wettability of the coating by molten-metal.

30. An endless flexible casting belt for use in a continuous metal casting machine for continuously casting molten-metal, said belt having fusion-bonded to a surface thereof a protective, insulative coating comprising:

a metallic material, a nonmetallic refractory material substantially uniformly interspersed throughout said metallic material, and said metallic material being in the form of a matrix holding, supporting and anchoring said nonmetallic refractory material on the belt surface, said coating having a desired accessible porosity of at least 8% of the total volume of the coating to enhance the non-wettability of the coating by molten-metal.

31. The belt of claim 30, wherein said refractory material is selected from the group comprising graphite, zirconia, magnesium zirconate, silica, and alumina.

32. The belt of claim 31, wherein said refractory material comprises zirconia and a heat stabilizing material selected from the group consisting of yttria, magnesia, and lime.

33. The flexible casting belt of claim 32, wherein the heat stabilizing agent is yttria present in an amount up to about 20 percent by weight.

34. The flexible casting belt of claim 33, wherein there is also present in the non-metallic refractory material a flow enhancing amount of a lubricant.

35. The flexible casting belt of claim 34, wherein the flow enhancing lubricant is spherical fumed silica having a particle size of about 0.014 micrometers (14 millicrons) and is present in an amount of from about 0.2 to about 0.8 percent by weight.

36. The flexible casting belt of claim 31, wherein the non-metallic refractory material comprises from about 15 to about 25 percent by weight.

37. The flexible casting belt of claim 31, wherein the non-metallic refractory material is powdered zirconia having a particle size of from about 0.0005 to about 0.0014 of an inch (12 to 36 micrometers).

38. The belt of claim 30, in which:

said metallic material comprises from about 38 to about 90 percent by weight of said coating.

39. The flexible casting belt of claim 38, wherein the metallic material is a metal or metal alloy in which the metal is selected from the group consisting of nickel, cobalt, iron and titanium.

40. The belt of claim 30, in which:

said nonmetallic refractory material comprises from about 10 to about 62 percent by weight of said coating.

41. The belt of claim 30, wherein said coating has a thickness in the range from about 0.0015 of an inch to about 0.015 of an inch (about 0.04 mm to about 0.4 mm).

42. The belt of claim 30, in which:

said metallic matrix is thermal-fusion-bonded to the belt surface, said metallic and nonmetallic materials were thoroughly substantially uniformly intermixed in powdered form before the metallic matrix was thermal-fusion-bonded to the belt surface, and said coating has an accessible porosity comprising at least 8% of the total volume of said coating.

43. The belt of claim 30, in which:

said nonmetallic material in powder form includes zirconia powder of fine particle size passing through a screen having 300 or more wires per inch.

44. The flexible casting belt of claim 30, wherein the ratio of the specific gravity of the metallic material to the non-metallic refractory material is in the range of from about 1½:1 to about 4:1.

45. An endless flexible casting belt for use in a continuous metal casting machine for continuously casting molten-metal, said belt having fusion bonded to a surface thereof, a protective insulative coating comprising:

a metallic material having the properties of:

(a) heat resistance relative to the temperature of the metal to be cast and resistance to thermal cycling, (b) thermal fusion bonding compatibility with the belt surface, (c) a modicum of ductility for withstanding repeated flexing around a pulley roll, (d) sufficient resistance to oxidation under the conditions of thermal spraying and also under the conditions to be encountered in continuous casting for avoiding undue oxidation, and (e) thermal expansion rates compatible with predetermined nonmetallic refractory material, said predetermined nonmetallic refractory material being dispersed substantially uniformly throughout said metallic material, and said metallic material being in the form of a matrix holding, supporting and anchoring said nonmetallic material on the belt, said coating having a desired accessible porosity of at least 6% of the total volume of the coating to enhance the non-wettability of the coating by molten-metal.

46. An endless flexible casting belt for use in a continuous metal casting machine for continuously casting molten-metal, said belt having fusion bonded to a surface thereof, a protective insulative coating comprising:

a metallic material having the properties of:

(a) heat resistance relative to the temperature of the metal to be cast and resistance to thermal cycling, (b) thermal fusion bonding compatibility with the belt surface, (c) a modicum of ductility for withstanding repeated flexing around a pulley roll, (d) sufficient resistance to oxidation under the conditions of thermal spraying and also under the conditions to be encountered in continuous casting for avoiding undue oxidation, and (e) thermal expansion rates compatible with predetermined nonmetallic refractory material, said predetermined nonmetallic refractory material being dispersed substantially uniformly throughout said metallic material, and said metallic material being in the form of a matrix holding, supporting and anchoring said nonmetallic material on the belt, said coating having a desired accessible porosity of at least 8% of the total volume of the coating to enhance the non-wettability of the coating by molten-metal.

47. The belt of claim 46, in which:

said metallic material comprises from about 38 to about 90 percent by weight of said coating.

48. The flexible casting belt of claim 47, wherein the metallic material is a metal or metal alloy in which the metal is selected from the group consisting of nickel, cobalt, iron and titanium.

49. The belt of claim 46, in which:

said nonmetallic refractory material comprises from about 10 to 62 about percent by weight of said coating.

50. The belt of claim 46, wherein said refractory material is selected from the group comprising graphite, zirconia, magnesium zirconate, silica, and alumina.

51. The belt of claim 50, wherein said refractory material comprises zirconia and a heat stabilizing material selected from the group consisting of yttria, magnesia, and lime.

52. The flexible casting belt of claim 51, wherein the heat stabilizing agent is yttria present in an amount up to about 20 percent by weight.

53. The flexible casting belt of claim 52, wherein there is also present in the non-metallic refractory material a flow enhancing amount of a lubricant.

54. The flexible casting belt of claim 53, wherein the flow enhancing lubricant is spherical fumed silica having a particle size of about 0.014 micrometers (14 millicrons) and is present in an amount of from about 0.2 to about 0.8 percent by weight.

55. The flexible casting belt of claim 50, wherein the non-metallic refractory material is powdered zirconia having a particle size of from about 0.0005 to about 0.0014 of an inch (12 to 36 micrometers).

56. The flexible casting belt of claim 50, wherein the non-metallic refractory material is powdered zirconia having a particle size of from about 0.0005 to about 0.0014 of an inch (12 to 36 micrometers).

57. The flexible casting belt of claim 50, wherein the non-metallic refractory material comprises from about 15 to about 25 percent by weight.

58. The belt of claim 46, wherein said coating has a thickness in the range from about 0.0015 of an inch to about 0.015 of an inch.

59. The flexible casting belt of claim 46, wherein the ratio of the specific gravity of the metallic material to the non-metallic refractory material is in the range of from about 1½:1 to about 4:1.

60. The method of forming a fusion-bonded insulative and protective matrix coating on the clean, roughened surface of an endless flexible metallic casting belt for use in a continuous casting machine, comprising the steps of:

providing a powder mixture containing (1) heat-resisting metallic material, and (2) insulative, non-metallic refractory material, said metallic material constituting such a weight percent of said powder that subsequent thermal spraying of said powder onto said surface results in a continuous matrix of said metallic alloy with said nonmetallic material dispersed through said matrix and with said matrix holding said nonmetallic material and securing said nonmetallic material to said surface, and thermal spraying said powder mixture onto said surface for forming said insulative and protective matrix coating, and thereby creating a desired accessible porosity of at least 6% of the total volume of the coating to enhance the non-wettability of the coating by molten-metal.

61. The method of claim 60, in which:

said metallic material does not exceed 90 percent by weight of said powder.

62. The method of claim 61, in which:

said heat-resisting metallic material includes a preponderance by weight of nickel.

63. The method of claim 61, in which:

said heat-resisting metallic material includes a significant percent by weight of cobalt.

64. The method of claim 60, in which:

said nonmetallic refractory material is at least 10 percent by weight of said powder.

65. The method of claim 60, in which:

said surface of said belt is roughened by grit blasting to within the range of 1,000 to 5,000 micro-inches (25 to 127 micro-meters) as measured by the method of surface grinding.

66. The method of claim 60, in which:

the major proportion by weight of said nonmetallic refractory material is zirconia.

67. The method of claim 66, in which:

carbon is second most prevalent constituent by weight in said nonmetallic refractory material.

68. The method of claim 60, in which:

said powder mixture contains at least 0.2 percent by weight of fumed silica.

69. The method of claim 68, wherein the fumed silica have a particle size of about 0.014 micrometers (14 millimicrons) and is present in an amount of from about 0.2 to about 0.8 percent by weight.

70. The method of claim 29, wherein said metallic material comprises about 38 to about 90 percent by weight of said coating.

71. The method of claim 70, wherein the metallic material is a metal or metal alloy in which the metal is selected from the group consisting of nickel, cobalt, iron and titanium.

72. The method of claim 71, wherein the non-metallic refractory material is selected from the group consisting of graphite, zirconia, magnesium, zirconate, silica and alumina.

73. The method of claim 72, wherein the metallic material comprises nickel and the non-metallic refractory material comprises from about 15 to about 25 percent by weight.

74. The method of claim 72, wherein the non-metallic refractory material is powdered zirconia having a particle size of from about 0.0005 to about 0.0014 of an inch (12 to 36 micrometers).

75. The method of claim 72, wherein said substantially uniform mixture of metallic material and non-metallic refractory material has present therein a heat stabilizing amount of a heat stabilizing agent selected from the group consisting of yttria, magnesia and lime.

76. The method of claim 75, wherein the heat stabilizing agent is yttria in an amount up to about 20 percent by weight.

77. The method of claim 75, wherein the substantially uniform mixture of metallic material and non-metallic refractory material has present therein a flow enhancing amount of a lubricant material.

78. The method of claim 70, wherein the ratio of the specific gravity of metallic material to the non-metallic refractory material is in the range of from about 1-½:1 to about 4:1.

79. An endless flexible casting belt for use in a continuous casting machine for continuously casting molten-metal comprising:

a flexible, metallic belt having a thickness greater than 0.025 of an inch (0.63 mm), said belt having bonded on a surface which faces the molten-metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, said coating having a desired accessible porosity of at least 8% of the total volume of the coating to enhance the non-wettability of the coating by molten-metal.

80. The flexible casting belt of claim 79, in which:

said metallic material is nickel or an alloy of nickel.

81. The flexible casting belt of claim 79, in which:

said metallic material is cobalt or an alloy of cobalt.

82. The flexible casting belt of claim 79, in which:

said surface of said metallic belt to which said insulative, heat-resistant coating is bonded has, as a result of grit-blasting, a roughness of 1000 to 5000 micro-inches (25 to 127 micro-meters) as measured by the method of surface grinding.

83. The flexible casting belt of claim 79, in which:

said metallic material is a metal or an alloy of a metal selected from the group consisting of nickel, cobalt, iron and titanium.

84. The flexible casting belt of claim 79, in which:

said thermally sprayed mixture contains nickel or nickel alloy in the range from about 38 to about 90 percent by weight, and the major proportion by weight of said refractory material is zirconia.

85. The flexible casting belt of claim 79, in which:

said thermally sprayed mixture contains nickel alloy in the range from about 38 to about 90 percent by weight, and said refractory material contains most prevalently zirconia and graphite.

86. The flexible casting belt of claim 79, in which:

said thermally sprayed mixture contains nickel or nickel alloy in the range from about 38 to about 90 percent by weight, and said refractory material comprises mainly graphite.

87. The flexible casting belt of claim 79, in which:

said belt is capable of flexing repeatedly around a pulley roll having a diameter of 20 inches (508 mm), without occurrence of flaking or spalling of said insulative, heat-resistant coating.

88. The flexible casting belt of claim 79, in which:

said thermally sprayed mixture includes at least 0.2 percent by weight of spherical fumed silica.

89. The flexible casting belt of claim 79, wherein the metallic material is a metal or metal alloy in which the metal is selected from the group consisting of nickel, cobalt, iron and titanium.

90. The flexible casting belt of claim 79, wherein the ratio of the specific gravity of the metallic material to the non-metallic refractory material is in the range of from about 1½:1 to about 4:1.

91. The flexible casting belt of claim 79 in which the metallic material is selected from the group consisting of nickel, cobalt, iron and titanium.

92. The flexible casting belt of claim 91, wherein the metallic material comprises about 38 to about 92 percent by weight of said coating.

93. The flexible casting belt of claim 92, wherein the non-metallic refractory material is selected from the group consisting of graphite, zirconia, magnesium zerconate, silica and alumina.

94. The flexible casting belt of claim 93, wherein the non-metallic refractory material comprises from about 15 to about 25 percent by weight.

95. The flexible casting belt of claim 93, wherein the ratio of the specific gravity of the metallic material to the non-metallic refractory material is in the range of from about 1½:1 to about 4:1.

96. The flexible casting belt of claim 93, wherein the non-metallic refractory material is powdered zirconia having a particle size of from about 0.0005 to about 0.0014 of an inch (12 to 36 micrometers).

97. The flexible casting belt of claim 96, wherein there is also present a heat stabilizing agent selected from yttria, magnesia and lime.

98. The flexible casting belt of claim 97, wherein the heat stabilizing agent is yttria present in an amount up to about 20 percent by weight.

99. The flexible casting belt of claim 98, wherein there is also present coating a flow enhancing amount of a lubricant.

100. The flexible casting belt of claim 99, wherein the flow enhancing lubricant is spherical fumed silica having a particle size 7 about 0.014 micrometers (14 millicrons) and is present in an amount of from about 0.2 to about 0.8 percent by weight.

101. The method of forming a fusion-bonded insulative and protective matrix coating on the clean, roughened surface of an endless flexible metallic casting belt for use in a continuous casting machine, comprising the steps of:

providing a powder mixture containing (1) heat-resisting metallic material, and (2) insulative, non-metallic refractory material, said metallic material constituting such a weight percent of said powder that subsequent thermal spraying of said powder onto said surface results in a continuous matrix of said metallic alloy with said nonmetallic material dispersed throughout said matrix and with said matrix holding said nonmetallic material and securing said nonmetallic material to said surface, and thermal spraying said powder mixture onto said surface for forming said insulative and protective matrix coating, and wherein said powder mixture has the composition:

| Constituent | Weight percent |
|---|---|
| Metallic component: | |
| Aluminum | 4 to 5 |
| Molybdenum | 2 to 3 |
| Nickel, plus trace impurities | 55 to 57.5 |
| Nonmetallic component: | |
| Zirconia | 35 |
| Calcium oxide, in the zirconia | 1.5 to 2 |

wherein the sum of the metallic and nonmetallic components is equal to 100 weight percent.

102. The method of forming a fusion-bonded insulative and protective matrix coating on the clean, roughened surface of an endless flexible metallic casting belt for use in a continuous casting machine, comprising the steps of:

providing a powder mixture containing (1) heat-resisting metallic material, and (2) insulative, non-metallic refractory material, said metallic material constituting such a weight percent of said powder that subsequent thermal spraying of said powder onto said surface results in a continuous matrix of said metallic alloy with said nonmetallic material dispersed throughout said matrix and with said matrix holding said nonmetallic material and securing said nonmetallic material to said surface, and thermal spraying said powder mixture onto said surface for forming said insulative and protective matrix coating, and wherein said powder mixture has the composition:

| Constituent | Weight percent |
|---|---|
| Metallic component: | |
| Aluminum | 6 |
| Molybdenum | 4 |
| Nickel, plus trace impurities | 52 |
| Nonmetallic component: | |
| Zirconia | 22 to 23 |
| Calcium oxide, in the zirconia | 1 to 1.5 |
| Graphite | 13 to 14.8 |
| Spherical fumed silica | 0.2 to 0.5 |

wherein the sum of the metallic and nonmetallic components is equal to 100 weight percent.

103. The method of forming a fusion-bonded insulative and protective matrix coating on the clean, roughened surface of an endless flexible metallic casting belt for use in a continuous casting machine, comprising the steps of:

providing a powder mixture containing (1) heat-resisting metallic material, and (2) insulative, non-metallic refractory material, said metallic material constituting such a weight percent of said powder that subsequent thermal spraying of said powder onto said surface results in a continuous matrix of said metallic alloy with said nonmetallic material dispersed throughout said matrix and with said matrix holding said nonmetallic material and securing said nonmetallic material to said surface, and thermal spraying said powder mixture onto said surface for forming said insulative and protective matrix coating, and wherein said powder mixture has the composition:

| Constituent | Weight percent |
|---|---|
| Metallic component: | |
| Nickel, plus trace impurities | 57 to 60 |
| Nonmetallic component: | |
| Zirconia | 25 to 28.8 |
| Calcium oxide, in the zirconia | 1 to 1.5 |
| Graphite | 13 to 15 |
| Spherical fumed silica | 0.2 to 0.5 |

wherein the sum of the metallic and nonmetallic components is equal to 100 weight percent.

104. The method of forming a fusion-bonded insulative and protective matrix coating on the clean, roughened surface of an endless flexible metallic casting belt for use in a continuous casting machine, comprising the steps of:

providing a powder mixture containing (1) heat-resisting metallic material, and (2) insulative, non-metallic refractory material, said metallic material constituting such a weight percent of said powder that subsequent thermal spraying of said powder onto said surface results in a continuous matrix of said metallic alloy with said nonmetallic material dispersed throughout said matrix and with said matrix holding said nonmetallic material and securing said nonmetallic material to said surface, and thermal spraying said powder mixture onto said surface for forming said insulative and protective matrix coating, and wherein said powder mixture has the composition:

| Constituent | Weight percent |
|---|---|
| Metallic component: | |
| Chromium | 14 |
| Nickel, plus trace impurities | 54 |
| Nonmetallic component: | |
| Zirconia | 29.8 to 30.4 |
| Calcium oxide, in the zirconia | 1.4 to 1.6 |
| Spherical fumed silica | 0.2 to 0.6 |

wherein the sum of the metallic and nonmetallic components is equal to 100 weight percent.

105. The method of forming a fusion-bonded insulative and protective matrix coating on the clean, roughened surface of an endless flexible metallic casting belt for use in a continuous casting machine, comprising the steps of:

providing a powder mixture containing (1) heat-resisting metallic material, and (2) insulative, nonmetallic refractory material, said metallic material constituting such a weight percent of said powder that subsequent thermal spraying of said powder onto said surface results in a continuous matrix of said metallic alloy with said nonmetallic material dispersed throughout said matrix and with said matrix holding said nonmetallic material and securing said nonmetallic material to said surface, and thermal spraying said powder mixture onto said surface for forming said insulative and protective matrix coating, and wherein said powder mixture has the composition:

| Component | Weight percent |
|---|---|
| Metallic component | 38 to 90 |
| Nonmetallic component | 62 to 10 |
| | 100% |
| Constituents of metallic component: | |
| Aluminum | 0 to 35 |
| Nickel, plus trace impurities | balance |
| Constituents of nonmetallic component: | |
| Graphite | 0 to 40 |
| Spherical fumed silica | 0.3 to 0.8 |
| Lime | 4 to 20 of the sum of Zirconia plus Lime |
| Zirconia | balance |

wherein the sum of the metallic and nonmetallic components is equal to 100 weight percent.

106. An endless flexible casting belt for use in a continuous casting machine for continuously casting molten metal comprising:

a flexible, metallic belt having a thickness greater than 0.025 of an inch (0.63 mm), said belt having bonded on a surface which faces the molten metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, wherein said insulative heat-resistant coating has the composition:

| Constituent | Weight percent |
|---|---|
| Metallic component: | |
| Aluminum | 4 to 5 |
| Molybdenum | 2 to 3 |
| Nickel, plus trace impurities | 55 to 57.5 |
| Nonmetallic component: | |
| Zirconia | 35 |
| Calcium oxide, in the zirconia | 1.5 to 2 |

wherein the sum of the metallic and nonmetallic components is equal to 100 weight percent.

107. An endless flexible casting belt for use in a continuous casting machine for continuously casting molten metal comprising:

a flexible, metallic belt having a thickness greater than 0.025 of an inch (0.63 mm), said belt having bonded on a surface which faces the molten metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, wherein said insulative heat-resistant coating has the composition:

| Constituent | Weight percent |
|---|---|
| Metallic component: | |
| Aluminum | 6 |
| Molybdenum | 4 |
| Nickel, plus trace impurities | 52 |
| Nonmetallic component: | |
| Zirconia | 22 to 23 |
| Calcium oxide, in the zirconia | 1 to 1.5 |
| Graphite | 13 to 14.8 |
| Spherical fumed silica | 0.2 to 0.5 |

wherein the sum of the metallic and nonmetallic components is equal to 100 weight percent.

108. An endless flexible casting belt for use in a continuous casting machine for continuously casting molten metal comprising:

a flexible, metallic belt having a thickness greater than 0.025 of an inch (0.63 mm), said belt having bonded on a surface which faces the molten metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, wherein said insulative heat-resistant coating has the composition:

| Constituent | Weight percent |
|---|---|
| Metallic component: | |
| Nickel, plus trace impurities | 57 to 60 |
| Nonmetallic component: | |
| Zirconia | 25 to 28.8 |
| Calcium oxide, in the zirconia | 1 to 1.5 |
| Graphite | 13 to 15 |
| Spherical fumed silica | 0.2 to 0.5 |

wherein the sum of the metallic and nonmetallic components is equal to 100 weight percent.

109. An endless flexible casting belt for use in a continous casting machine for continously casting molten metal comprising:

a flexible, metallic belt having a thickness greater than 0.025 of an inch (0.63 mm), said belt having bonded on a surface which faces the molten metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, wherein said insulative heat-resistant coating has the composition:

| Constituent | Weight percent |
|---|---|
| Metallic component: | |
| Chromium | 14 |
| Nickel, plus trace impurities | 54 |
| Nonmetallic component: | |
| Zirconia | 29.8 to 30.4 |
| Calcium oxide, in the zirconia | 1.4 to 1.6 |
| Spherical fumed silica | 0.2 to 0.6 |

wherein the sum of the metallic and nonmetallic components is equal to 100 weight percent.

110. An endless flexible casting belt for use in a continous casting machine for continuously casting molten metal comprising:

a flexible, metallic belt having a thickness greater than 0.025 of an inch (0.63 mm), said belt having bonded on a surface which faces the molten metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, wherein said insulative heat-resistant coating has the composition:

| Component | Weight percent |
|---|---|
| Metallic component | 38 to 90 |
| Nonmetallic component | 62 to 10 |
| | 100% |
| Constituents of metallic component: | |
| Aluminum | 0 to 35 |
| Nickel, plus trace impurities | balance |
| Constituents of nonmetallic component: | |
| Graphite | 0 to 40 |
| Spherical fumed silica | 0.3 to 0.8 |
| Lime | 4 to 20 of the sum of Zirconia plus Lime |
| Zirconia | balance |

wherein the sum of the metallic and nonmetallic components is equal to 100 weight percent.

111. An endless flexible casting belt for use in a continuous casting machine for continuously casting molten-metal comprising:

a flexible, metallic belt having a thickness greater than 0.025 of an inch (0.63 mm), said belt having bonded on a surface which faces the molten-metal an insulative, heat-resistant coating comprising a thermally sprayed mixture comprising as deposited:

a continuous matrix or reticulum of a heat-resistant metallic material having interspersed throughout such matrix or reticulum at least one nonmetallic insulative refractory material, said coating having a desired accessible porosity of at least 6% of the total volume of the coating to enhance the nonwettability of the coating by molten-metal.

* * * * *